US008790468B2

(12) United States Patent
Simonette

(10) Patent No.: US 8,790,468 B2
(45) **Date of Patent: *Jul. 29, 2014**

(54) STABILIZED VERTICAL SURFACE CLEANING

(75) Inventor: Dallas W. Simonette, Las Vegas, NV (US)

(73) Assignee: Sky Robotics, Inc., Little Canada, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/218,347

(22) Filed: Jul. 14, 2008

(65) Prior Publication Data

US 2009/0044833 A1 Feb. 19, 2009

Related U.S. Application Data

(60) Provisional application No. 60/959,409, filed on Jul. 13, 2007.

(51) Int. Cl.

| | |
|---|---|
| ***B08B 1/04*** | (2006.01) |
| ***B08B 3/04*** | (2006.01) |
| ***A47L 11/38*** | (2006.01) |
| ***A47L 1/00*** | (2006.01) |
| ***A47L 1/02*** | (2006.01) |
| ***E04G 3/34*** | (2006.01) |
| ***E04G 23/00*** | (2006.01) |

(52) U.S. Cl.

CPC ... *A47L 1/02* (2013.01); *E04G 3/34* (2013.01); *E04G 23/002* (2013.01)

USPC ..... 134/56 R; 15/49.1; 15/50.3; 15/103

(58) Field of Classification Search

USPC ..... 15/50.1, 50.3, 103; 134/198, 201

See application file for complete search history.

(56) References Cited

U.S. PATENT DOCUMENTS

| | | | |
|---|---|---|---|
| 3,080,592 | A | 3/1963 | Hassage |
| 3,108,301 | A | 10/1963 | Jones |
| 3,292,193 | A | 12/1966 | Littin |
| 3,298,052 | A | 1/1967 | Wolfe |
| 3,344,454 | A | 10/1967 | Mikalson |
| 4,198,724 | A | 4/1980 | Fisher et al. |
| 4,426,751 | A | 1/1984 | Nordeen |
| 5,014,803 | A | 5/1991 | Urakami |

(Continued)

FOREIGN PATENT DOCUMENTS

| | | |
|---|---|---|
| EP | 0271454 | 6/1988 |

OTHER PUBLICATIONS

A. Nishi; Development of Wall-Climbing Robots; Computers & Electrical Engineering, vol. 22, No. 2, pp. 123-149; 1996.*

(Continued)

*Primary Examiner* — Michael Kornakov
*Assistant Examiner* — Natasha Campbell
(74) *Attorney, Agent, or Firm* — Richard John Bartz

(57) ABSTRACT

A cleaning system for cleaning a surface comprising: a frame for the cleaning system; a liquid supply source; a liquid applicator; and at least one thruster on the frame to provide force against the frame to maintain support with the surface to be cleaned. A surface is cleaned by providing the cleaning device, moving the cleaning device both horizontally and vertically along the surface, and stabilizing the cleaning device with at least one thruster emitting a fluid stream comprising gas.

20 Claims, 16 Drawing Sheets

(56) References Cited

U.S. PATENT DOCUMENTS

| | | | | |
|---|---|---|---|---|
| 5,201,090 | A | 4/1993 | Jans | |
| 5,249,326 | A | 10/1993 | Jefferies | |
| 5,707,455 | A | 1/1998 | Tomita | |
| 5,715,557 | A | 2/1998 | Hsu | |
| 5,890,250 | A | 4/1999 | Lange et al. | |
| 5,901,720 | A | 5/1999 | Lange | |
| 6,016,924 | A | 1/2000 | Caliva | |
| RE36,649 | E | 4/2000 | Jefferies et al. | |
| 6,090,221 | A | 7/2000 | Gan et al. | |
| 6,120,262 | A | 9/2000 | McDonough et al. | |
| 6,158,678 | A | 12/2000 | Lange | |
| 6,170,109 | B1 | 1/2001 | Jesadanont et al. | |
| 6,550,090 | B1 | 4/2003 | Jesadanont et al. | |
| 6,601,256 | B2 | 8/2003 | Lee | |
| 6,802,098 | B2 | 10/2004 | Geyer et al. | |
| 6,910,678 | B2 | 6/2005 | Small | |
| 7,035,758 | B1 * | 4/2006 | Jerome | 702/150 |
| 7,093,318 | B2 | 8/2006 | Konrad | |
| 7,523,517 | B2 | 4/2009 | Yu | |
| 2003/0106176 | A1 * | 6/2003 | Wang | 15/50.3 |
| 2006/0096050 | A1 * | 5/2006 | Simonette et al. | 15/103 |
| 2009/0044833 | A1 | 2/2009 | Simonette | |
| 2009/0100618 | A1 | 4/2009 | Chen | |

OTHER PUBLICATIONS

*Random House Compact Unabridged Dictionary* , Special Second Edition, Random House New York1996, p. 25.

* cited by examiner

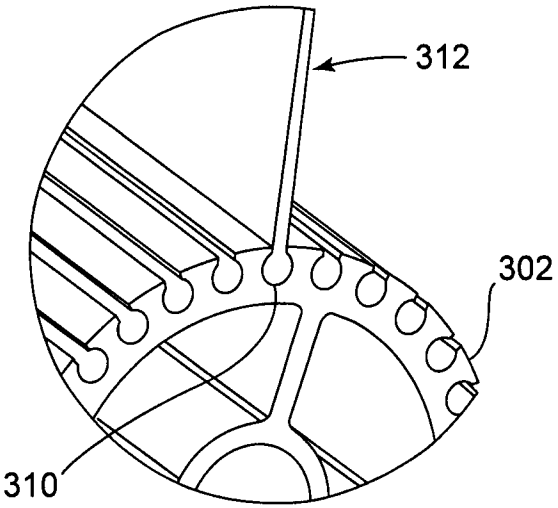
FIG. 4B
Prior Art
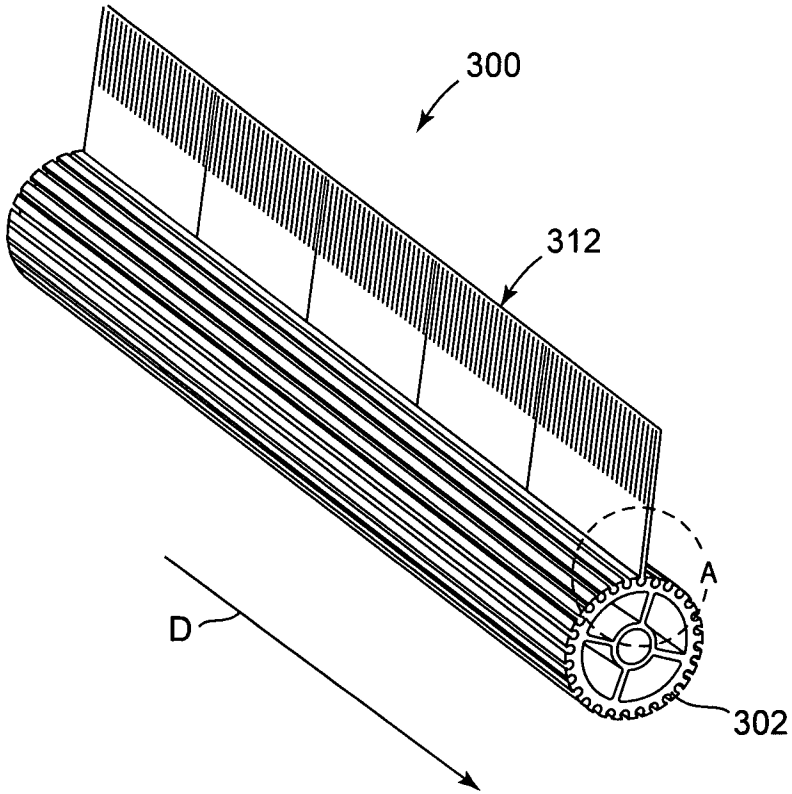

STABILIZED VERTICAL SURFACE CLEANING

RELATED APPLICATION DATA

This application claims priority from U.S. Provisional Application Ser. No. 60/959,409, filed 13 Jul. 2007.

BACKGROUND OF THE INVENTION

1. Field of the Invention

The present invention relates to cleaning systems, particularly liquid application cleaning systems, automated cleaning systems, and cleaning systems for structures, such as buildings. In particular, the present technology relates to supported platforms that are stabilized by one or more thrusters directing a platform against a vertical surface.

2. Background of the Art

Building structures, particularly tall urban buildings, are typically washed manually. A scaffolding structure is usually suspended from the top of the building to be washed. The scaffolding can be raised or lowered so that a person standing on the scaffolding can wash the windows and exterior surfaces of the building by hand. After a vertical section of the building is washed, the scaffolding is repositioned laterally so that the next adjacent vertical section of the building may be cleaned. This procedure may be repeated until the entire building has been washed. Cleaning windows using scaffolding is extremely time consuming. In an effort to reduce time and cost, therefore being more competitive in the industry, window washers tie a climbing rope to the roof anchors provided for the scaffolding and throw the rope over the side of the building. Then they attach a bosons chair to the rope and a climber's harness to themselves with repelling hardware. The man goes over the side of the building with his tools and water/soap bucket and cleans 6-8 of horizontal glass width per story. Then repels down to the next level and repeats until that drop is complete.

Manual washing of buildings has proven to be quite dangerous, especially with respect to tall skyscrapers. Typical wind and air drafts surrounding a building can exert a significant aerodynamic force upon a scaffolding structure or window cleaning laborer, causing them to swing out and away from the building, and placing persons standing on that scaffolding or suspended on a rope in peril. Injuries from manual window washing operations are common, and have caused insurance rates to soar. Typically, the cost of insuring a window washing operation can reach 40% of the labor costs. Furthermore, the manual washing of building exteriors is slow and labor-intensive.

Effectively removing mineral deposits from building windows has been a problem which has long plagued the industry. Normal water supplies conventionally used for wash water contain some amount of dissolved solids, including calcium, magnesium, and sodium in the form of bicarbonates, carbonates, chlorides, or sulfates. Regardless of the type or form of the dissolved solids, when a water droplet is allowed to dry on a surface, the solids typically remain as deposits on the surface.

When washing a window, a single water drop left on the surface will typically contain between 300 and 1000 parts per million of dissolved solids, in addition to varying amounts of suspended solids removed from the surface by washing. When water drops evaporate, mineral deposits are left in "spots". Compounding the spotting problem is the fact that when a window is being cleaned in sunlight, the surface of the window can be elevated to as much as 120 F Wash water in such circumstances evaporates quickly and can be seen to "steam" off of the window. Heavy and ultimately damaging mineral deposits can result.

Surface active agents (i.e., cleaning agents), such as polyphosphate and organic detergents, serve to spread adhering water drops over a wider area, making water spotting less noticeable. However, the effect is only cosmetic as the accumulation of hard mineral deposits as a whole is unaffected.

Although various automatic window washing devices have been described in the art (see, for example, U.S. Pat. Nos. 3,344,454 and 3,298,052), few of any such devices have proven to be practical or accepted in use. Such devices typically employ mechanical techniques to scrub the surface and to remove residual water. These cleaners suffer from a combination of several problems. First, many require some form of tracking (e.g., vertical mullions) on the building facade to guide the device up and down and maintain cleaning contact with the surface. Second, many include elaborate mechanical water collection and liquid removal apparatus, adding weight and expense to the overall device. Finally, since it is difficult to completely remove all of the wash water from the surfaces, and since all devices known to the inventor use common tap water (with or without detergents) as the washing medium, they tend to clean ineffectively, leaving mineral deposits from the tap water itself.

It is desirable to use unmanned, self-propelled vehicles such as robots to perform a variety of functions that would be difficult or dangerous for a person to perform. For example many people frequently use robots to retrieve or dispose an explosive device or inspect or work in an environment that could kill or injure a person. People also frequently use robots to inspect or work in locations that typically are hard to access or are inaccessible by a person such as inspecting a pipeline.

Unfortunately, because robots typically propel themselves to a work site, use of most conventional unmanned, self-propelled vehicles is typically significantly limited by the ability of the robot to propel itself over a surface and the complexity of the device stabilizing itself against ambient conditions such as wind, precipitation and changing surface shapes and conditions. For example, surfaces that include compound curves or three dimensional curves, abrupt inclinations or declinations, steps or gaps can cause conventional robots to become significantly less stable, i.e., more likely to lose their preferred orientation relative to the surface, as they traverse the surface or turn on it. In addition, surfaces that are slippery can cause conventional robots to easily lose a significant portion, if not all, of their traction to the surface. If either happens while traversing an incline or inverted surface such as a ceiling, such a loss of traction could cause the robot to fall. Such a fall could seriously damage the robot, its payload if it has any, or the surface or other components of the structure the robot is traversing.

Another problem with conventional robots is they tend to scrub the surface as they traverse and turn or pronate relative to the surface because of forces applied by the scrubbing action. Yet another problem with conventional robots is they tend to bounce or jerk as they propel themselves across a surface. This can be a significant problem during use on glass surfaces.

U.S. Pat. No. 5,249,326 discloses a washing system comprising a cleaning device for cleaning exterior surfaces of buildings, means for suspending the cleaning device in contact with the building surface to be cleaned, and means for causing the washing unit to traverse the building surface to be cleaned. Means for restraining the cleaning device against the building surface to be cleaned are provided, said restraining means including a restraining cable having a free weight attached thereto, means for attaching the restraining cable to the building at a point above the cleaning device, and a member for attaching the restraining cable to the building at a point below the cleaning device, the member being mounted on a suction cup adapted to engage the building. In use, the restraining cable is attached to the building at a point above the cleaning device, then passes over the cleaning device, and is threaded through the member below the cleaning device, such that the free weight hangs below the member and exerts a downward force on the cable, and the cable thereby restrains the cleaning device against the building surface to be cleaned. Preferably, the member connected to the suction cup comprises a pulley. Alternatively, it may be a loop, a U-shaped piece, or any other structure having a bore or passage through which the restraining cable can pass.

U.S. Pat. No. 5,890,250 describes a robotic apparatus for applying fluids to the exterior surfaces of vertical, nearly vertical, or sloped surfaces with minimum human supervision. The robotic apparatus is designed to apply fluids to surfaces which may include obstacles such as window frames or gaps created by window seams, which the present invention is designed to traverse. The robotic apparatus includes housing, a drive assembly, a sliding vacuum assembly, a fluid spray assembly, and sensor and control systems. The drive assembly includes drive chains, cables, ropes or the like that are connected at one end to a carriage positioned on the top of the structure and to a stabilizing member or members at the other end.

U.S. Pat. No. 5,707,455 describes an automated cleaning method is provided for an exterior wall of a building. Elongated, water-tight or electrically-insulating hollow members are accommodated within upper and lower sash rails constructing said exterior wall so that said hollow members continuously extend in horizontal directions, respectively. An electrical conductor extends in one of the hollow members. The other hollow member forms a drainage system. A cleaning apparatus main unit is arranged so that said cleaning apparatus main unit is supplied with electric power through said conductor to permit self-traveling in a horizontal direction along said exterior wall and is also supplied with washing water from said drainage system to permit cleaning of a surface of said exterior wall. The washing water is drained into said drainage subsequent to the cleaning by said cleaning apparatus main unit. The washing water can be recirculated for reuse.

U.S. Pat. No. 5,014,803 describes a device, including a window cleaning device, comprising a main body, a motor and drive wheels mounted on the main body, a partitioning member mounted on the main body and defining a pressure reduction space in cooperation with the main body and a wall surface, and a vacuum pump for reducing the pressure of the pressure reduction space. The device can suction-adhere to the wall surface by the pressure of an ambient fluid acting on the main body owing to the difference in fluid pressure between the inside and outside of the pressure reduction space and move along the wall surface by the action of the moving member. The partitioning member has an outside wall portion extending from its one end to a contacting portion contacting the wall surface and an inside wall portion extending from the contacting portion to its other end. A stretchable and contractible portion is provided in at least one of the outside and inside wall portions, and the contacting portion moves toward and away from the wall surface by the stretching and contracting of the stretchable and contractible portion.

Published US Patent Application 20060096050, filed 11 May 2005 (Simonette et al.) describes a washing system for an elevated surface has a) a housing having a liquid application cleaning system therein; b) a support element that supports and elevates the washing system; c) a rigid member extending from a surface of the housing that faces away from a surface to be cleaned so that the cable, when supporting the cleaning system against the surface to be cleaned and connected to the housing at a connection point, exerts a rotational force on the cleaning system in relation to the fixed fulcrum at the roof top; and d) weights provided at a distance and direction from the connection point fulcrum to at least in part counterbalance the rotational force.

These references describe background technology that is incorporated herein by reference in its entirety and which may be used in combination with the novel technology of the present disclosure.

SUMMARY OF THE INVENTION

A moveable cleaning system enables cleaning of relatively flat surfaces, and especially elevated and/or sloped and/or vertical surfaces without the use of personnel at the specific site of cleaning. The system can be fully automated, with programming set to enable the system to clean an entire surface or structure (e.g., an office building or hotel) or allow system control by someone distal from or proximal to the direct point of application of the cleaning activity. The system may also be operated in full manual or semi-automated configuration by a single operator safely positioned within sight of the device (by direct observation or by cameras), for example on top of the building roof or in a control booth. An at least one first motor is provided on a moving carriage that contains the washing instrumentality. The at least one first motor may both drive washing elements and provide winch action to raise and lower and horizontally shift the washing platform along the vertical surface. Counterweights that may be used to keep the carriage in firm contact with the surface are optional in view of the inventive stabilizing technology of thrusters. A separate second motor may move a roof support carriage horizontally with respect to the surface, while a third motor may control vertical movement of the washing carriage. The third motor may be mounted on the roof support carriage or on the washing carriage. One or two motors may be combined for each or all of these tasks, so that only a single motor or only two motors may be present on the carriage/platform for the cleaning system for each or all of these functions. The platform is stabilized against movement away from the vertical surface by at least one thruster (e.g., comprising a gas thruster, such as an air thruster and/or residual/recaptured water thruster) positioned between at least two points of contact between the vertical surface and the moveable cleaning system.

BRIEF DESCRIPTION OF THE FIGURES

FIG. 4*b* shows a perspective view and a cutaway view of a support body having multiple vanes of flexible force applying material in the PRIOR ART, which can be modified to include thrusters according to the present technology.

DETAILED DESCRIPTION OF THE INVENTION

Figure 1:
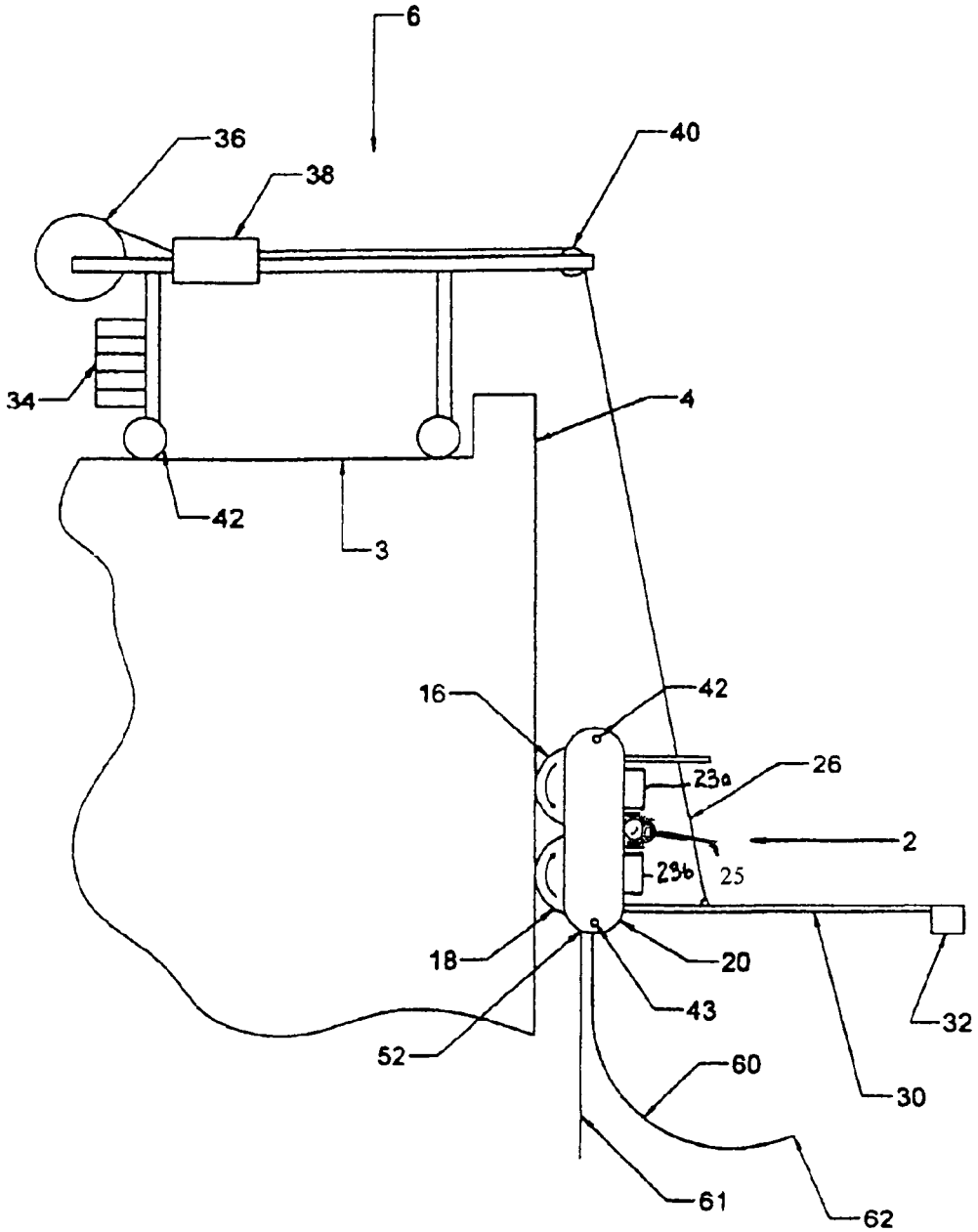
FIG. 1 shows a schematic side view of a cleaning apparatus alongside a building according to descriptions of technology provided herein.

A moveable cleaning system enables cleaning of relatively flat surfaces, and especially elevated and/or sloped and/or vertical surfaces without the use of personnel at the specific site of cleaning. The system ordinarily comprises a platform or frame carrying at least a connecting system to a vertical motion motivator, a connection to a horizontal motion control, a fluid transport system, a fluid applicator system and a stabilizing system comprising thrusters. A "thruster" according to the present technology is any system that propels fluids (especially gas, although water may be used) with a vector component away from (containing at least some component that is perpendicular to) the surface to be cleaned. Systems such as jets, fans, blowers, vacuum exhausts, defected gas streams and the like may be used. The system thrusts the fluid with a momentum away from the surface to be cleaned with sufficient force so as to apply an resulting force on the carriage against the surface to be cleaned. The system can be fully automated, with a processor containing programming set to enable the system to clean an entire surface or structure (e.g., an office building, monument, apartment, warehouse or hotel) or allow system control by someone distal from or proximal to the direct point of application of the cleaning activity. The system may also be operated in full manual or semi-automated configuration by a single operator safely positioned within sight of the device (by direct observation or by cameras), for example on top of the building roof or in a control booth.

The components of the system can be better appreciated by the following descriptions. The term "platform" means the structural support for the cleaning system and is not to be limited to support for personnel on the system, although that may be optionally included. In traditional window cleaning systems this requires a relatively flat panel for personnel to stand on when cleaning windows. As personnel are not required on the platform, although they may wish to have access to the system before, during or after use, or during repair procedures, the term platform is not limited to a flat surface, but may comprise a frame, shape or configuration that aggregates the essential elements of the system into an operating device, the frame allowing for a flat personnel support panel in the platform, but not requiring it. The platform may be open, covered, of enclosed, with only those externally necessary elements (cleaning functions and thruster functions and motion functions) external to an enclosing component for the system. The materials for the platform are selected on the basis of structural needs, considering such aspects as resistance to cleaning solutions, weight reduction, strength, durability and the like. Common structural materials such as metals, polymeric materials, composites, ceramics and the like may be selected.

The system also includes a vertical motion motivator. The vertical motion motivator may be a series of winches, pulleys, cables, caterpillar drives, and other systems that can elevate and lower the platform as needed. Preferably the vertical motivator system does not itself drive the cleaning system by traction against the surfaces to be cleaned (as would a caterpillar drive). The system preferably lifts and lowers the platform with essentially only cleaning elements or minimally driven rollers or glides in contact with the surface to be cleaned. Systems with at least one winch or pulley driving motor on a relatively high or highest level of the structure to be cleaned (e.g., on a roof, with or without a roof wall or ledge being present, on a crane on the roof, extended out of a roof work shed of exit way, etc.). On the platform there should also be a connection to a horizontal motion control, which may be integral with or separate from the vertical lift system. For example, any cables to the roof that lift or lower the platform may also be moved horizontally with respect to a roof or other elevated (or lower, e.g., a ledge) structural element. For example, vertical lift cables may be attached to a carriage, train, glide, rails or other system that can move the support for the vertical lift cables horizontally, thereby moving the platform horizontally at the same time.

The cleaning system ordinarily will require a fluid transport system, as most window washing is done with or in conjunction with fluid application. Spray wash systems, brush wash systems, roller applicator/scrub systems, fabric applicators, fabric strip applicators, and combinations thereof all use water to assist in surface soil removal and to minimize friction between any physical elements and surfaces being cleaned so as to reduce abrasion and scratching. The fluid may be water, treated water (e.g., demineralized, deionized, chemically treated) or other aqueous systems (with surfactants, ambiphilic materials to remain with the water but dissolve or soften hydrophobic and oleophilic materials) and other common cleaning fluids (ammonia, vinegar, etc.).

There is some form of a fluid applicator system that applies the liquids against the surfaces to be cleaned, usually with some attendant force or pressure. The applicator may be a spray device, jet spray, fountain spray, roller brush(es), fabric sheets with reciprocating movement, water and air jets, squeegee system and the like, as well understood in the art.

The novel stabilizing system of the present technology comprises thrusters, thrusting system or propulsion subsystem included in a thrusting system, according to various aspects of the invention, includes any structure suitable for developing a force primarily by accelerating fluid in an opposite direction In a thrust-based lifting unit, the force includes a horizontal component, or a component relatively (±30 degrees) perpendicular to the surface being cleaned. The accelerated fluid can include exhaust gases (e.g., from a motor) or ambient air (e.g., accelerated by a jet motor, fan, propeller, or turbine) or gases mixed with exhausted cleaning fluid. A thrusting system can consist of a single propulsion device, e.g., a propeller, jet engine, etc., or can include one or more propulsion subsystems. For example, thrusting system may employ a propeller and provides stabilizing horizontal thrust when the lift unit for the platform is active or is determined to be under forces causing objectionable movement. In another embodiment, multiple thrusting systems comprise a first torque producing or reducing propulsion subsystem and a second torque producing or reducing propulsion subsystem.

The thruster system may have single fixed vents, multiple fixed vents, single or multiple flexible vent(s), flared nozzle(s), and the thrusters may be adjustable on the platform (vertically and horizontally as well as angularly adjustable). The thrusters may be used either in continuous mode or in pulse mode or occasionally, from time to time (e.g., by manual control, programmed control, or responsive programmed control to changes in conditions). The thrusters may be symmetrically or asymmetrically disposed along the platform, both vertically, horizontally and with regard to angularity of thrust. Normal consideration should be given to rotational and displacing forces that are provided by the thrusters. For example, there is usually a long continuous point of contact by fluid applicators (e.g., a brush or brushes extending along the length of the platform) or at least two points of contact (e.g., two opposed direction rotating brushes) and forces applied by the thrusters should not destabilize the contact. That is, the thrust forces (at least collectively, if not individually) should be applied within a line or within a surface area defined by the extremities of the contact so that torque from the forces will not destabilize or rotate the platform about outer regions of the contact.

Gyroscopes 25, shown in FIG. 1, may also be provided in the system for stabilizing the platform against movement toward and away from the upright surface of the structure. The gyroscopes resist position change even with external physical force applied to the platform. Gyroscope(s) may be built into the platform and driven by electrical power (direct or from any other motor).

A first motor may be provided on a moving carriage that contains the washing instrumentality that may both drive washing elements and provide winch action to raise and lower and horizontally shift the washing platform along the vertical surface. Counterweights that keep the carriage in firm contact with the surface are optional in view of the inventive stabilizing technology of thrusters. A separate second motor may move a roof support carriage horizontally with respect to the surface, while a third motor may control vertical movement of the washing carriage. The third motor may be mounted on the roof support carriage or on the washing carriage. The platform is stabilize against movement away from the vertical surface by at least one thruster positioned between at least two points of contact between the vertical surface and the moveable cleaning system.

A cleaning system according to technology described herein may comprise at least two distinct components that interact to provide a complete cleaning system for the cleaning of relatively flat surfaces, such as the exterior vertical surfaces of office buildings, hotels, hospitals and other multistory structures with, by way of non-limiting examples, up to 8 or 10 inches of sharp vertical deviation from flatness between areas of the surfaces (e.g., vertical elevation of panels separating window areas). The system exhibits stability against winds and provides high quality cleaning ability on window surfaces without the use of personnel at the immediate cleaning areas. A non-limiting general description of the cleaning system described herein may be considered as a washing system for elevated surfaces comprising: a) a housing having a liquid application cleaning system therein; b) a support element that supports and elevates the washing system; and c) at least one thruster on the housing with exhaust direction away from (and approximately perpendicular to) a plane of contact between the liquid application system and a surface to be cleaned. It is optional to have d) a rigid member extending from a surface of the housing that faces away from a surface to be cleaned so that the cable, when supporting the cleaning system against the surface to be cleaned and connected to the housing at a connection point, exerts a rotational force on the cleaning system in respect to the fulcrum point at the roof rig connection point; and e) weights provided at a distance and direction from the connection point to at least in part counterbalance the rotational force around the connection point on the extended member.

The system may have the support element comprises a) a cable, b) hose, c) rope, or d) two or more of a rope, cable and hose. The system of may have the support element as an electrical cable. The system may have the connecting point and the weight located on the rigid member. The system may have the connecting point on the housing or the rigid member, and a pulley might carry the support cable to the connecting point, and a securing cable attaches the rigid member to the pulley. The cleaning system may comprise at least one roller that contacts the surface to be cleaned, or at least two rollers that contact the surface to be cleaned, as well as spray systems and combinations thereof.

The optional two distinct and interacting components of the system comprise a first component of a parapet wall-gripping support or a rooftop rolling support that controls movement along a direction relatively horizontal to a surface to be cleaned while supporting and possibly controlling the vertical movement of a second component cleaning carriage that moves horizontally and vertically along the surface to be cleaned. Both types of the first component comprises both a rotationally stabilizing support system that prevents the first component from being pulled off the building and a wheel-based system that allows the first component to be easily moved in a direction along a roof edge and relatively horizontal to the surface to be cleaned. The second component comprises a carriage that can move both horizontally and vertically with respect to the surface to be cleaned and contains a cleaning system, counterbalancing weight system and may have a motor that may control both vertical movement and provide stabilizing mass to the second component to assist in stabilizing the second component contact with the surface to be cleaned.

The cleaning system for the surfaces is generally particularly designed for glass or coated glass (e.g., surfaces having abrasion-resistant coatings, light filtering coatings, enhanced cleanable surfaces, etc.) surfaces, but any structure having a relatively flat surface can be cleaned by the present technology. The actual cleaning is done by the application of a cleaning liquid to the surface with sufficient forces involved in the time frame immediate with the liquid application or subsequent to the application to assist in removal of dirt, film, particles, soil age, caked material, deposits, and the like from the surface. Although many systems use jet spray or hand application, especially in conjunction with personnel at the cleaning site (e.g., handling applicators, squeegees, brushes, hoses, buckets, sprays, etc., as opposed to merely being on the roof directing the equipment), jet spray application is less preferred because of its tendency under Newton's Second Law of Motion to push the cleaning apparatus from the wall and make it more susceptible to displacement by ambient air currents and wind. Jet spray application, even with the assistance of heat and chemical, fails to clean the film coating on the surface being cleaned. Although glass is a primary surface to be cleaned, any surface material, such as concrete, mortar, brick, stone, metals, wood, composites and the like may also be cleaned. The jet spray may be particularly desirable with more porous or absorbing surfaces. A preferred application system comprises brush application, sponge application, strip application, foam finger application, sheet application and the like, where physical elements exert a physical force such as a rubbing action against the surface to be cleaned in the present of a cleaning liquid (which may be water, alone). The second component therefore usually may comprise a carriage for support of a motor, liquid delivery system, physical contact system for applying force against the surface to be cleaned while the surface is in contact with the liquid, and a counterbalancing weight system assisting in keeping the physical contact system in a cleaning orientation with respect to the surface to be cleaned. The thruster will provide the primary or only forces to stabilize the system, but additional stabilizing functions may also be present. Each of these elements will be discussed in greater detail in a review of the Figures of the described technology.

In reviewing the following figures, and especially the schematics, the proportions shown in the figures, and the specific position of elements is not intended to be limiting with respect to the structures disclosed or the scope of claims appended hereto, but rather are intended to be instructive of a generic concept that is enabled by the shown examples.

FIG. 1 shows a schematic side view of a cleaning apparatus or system 2 alongside a building 4 according to descriptions of technology provided herein. The cleaning system 2 has a first component 6 which is positioned on a roof top 3. The first component 6 may comprise various elements that accomplish the requirements of the specific elements described in the following disclosure. In FIG. 1 is shown a rolling carriage element which has lockable position castor wheels 42 which allows for transporting the washing unit 20 to the edge of the building and then providing the horizontal movement during the wash cycle. Optional counter weights 34 of sufficient weight to provide support for suspension of the washing element 20 over the side of the building. A grip style winch 38 powers the movement of cable 26 to provide the vertical operation for the washing element 20. Cable winder 36 stores the slack cable for use by winch 38. The second component may also comprise a first cable 26 or line support system 40, here shown as a pulley, to allow extended movement of a winch that operates on a cable or line 26 that supports the carriage 20. A winch and motor system 21 is shown on the pole 30 (which may also be a flat panel platform). Lengthening of available cable 26 allows for vertical movement of the carriage 20 with respect to the surface 4 to be cleaned. The carriage 20 may also comprise as part of the counterbalancing weight system a pole or rod 30 (here shown extending directly from general connection from the carriage 20, which ends with an optional counterbalancing weight 32 to provide a inward force for stabilization and washing. No thruster is shown on this Figure.

A pair of thrusters 23*a* 23*b* is shown on a back side (distal from contact of the brushes 16, 18 with the surface 4 to be cleaned) of the carriage 20. The thrusters 23*a* 23*b* are showed at somewhat different elevations on the carriage 20, primarily for convenience. They may be at the same or different elevations, and may be combustion powered or preferably electrically powered. An important consideration for the positioning of the thrusters is their location within an area or projected area of contact between the brushes 16 18 and the surface 4 to be cleaned. As long as at least one, and preferably both thrusters 23*a* 23*b* lie within the projected area of contact, torque forces will be reduced or eliminated so that the carriage is not rotated about any extreme contact point. All references to weights and counterweights in the remaining description refers to an optional feature in the present technology. Such weights and counterweights are not fundamental to the practice of the present technology.

The preferred cleaning action of the cleaning elements 16 and 18 in the carriage 20 may be generally described as the provision of liquid to the wall 4 (here shown with internal liquid applicators 42 and 43), and the application of forces against the wall 4 in the presence of delivered liquid, here the forces shown to be delivered by rotating elements 16, 18 within the carriage 20. The cleaning elements 16, 18 (which are described in greater detail later) preferably rotate in a predetermined manner. One preferred method is to have (from the perspective shown) applicator 18 rotate clockwise b and to have applicator 16 rotate counterclockwise c. In this manner or opposed rotation, cleaning action is performed on all horizontal and vertical surfaces that are perpendicular to the vertical face of the building (i.e. window frames) with a single pass of the cleaning carriage. A second feature is that liquid is moved rearwardly where it maybe easily collected if desired. Liquid may be carried within the carriage for reapplication or collection for controlled disposal as may be required by local EPA authorities. More preferably a hose system 60 carries liquid from an upper end 62 attached to a liquid supply system (e.g., a deionized water tank, not shown) to the carriage 20 and applicators 42 and 43).

In FIG. 1, a liquid capture area 52 in the lower portion of housing 20 can be provided to collect the dirty water via drain hose 61 and send it to collection tank on the ground or roof top for proper disposal as may be required by the EPA.

Figure 2:
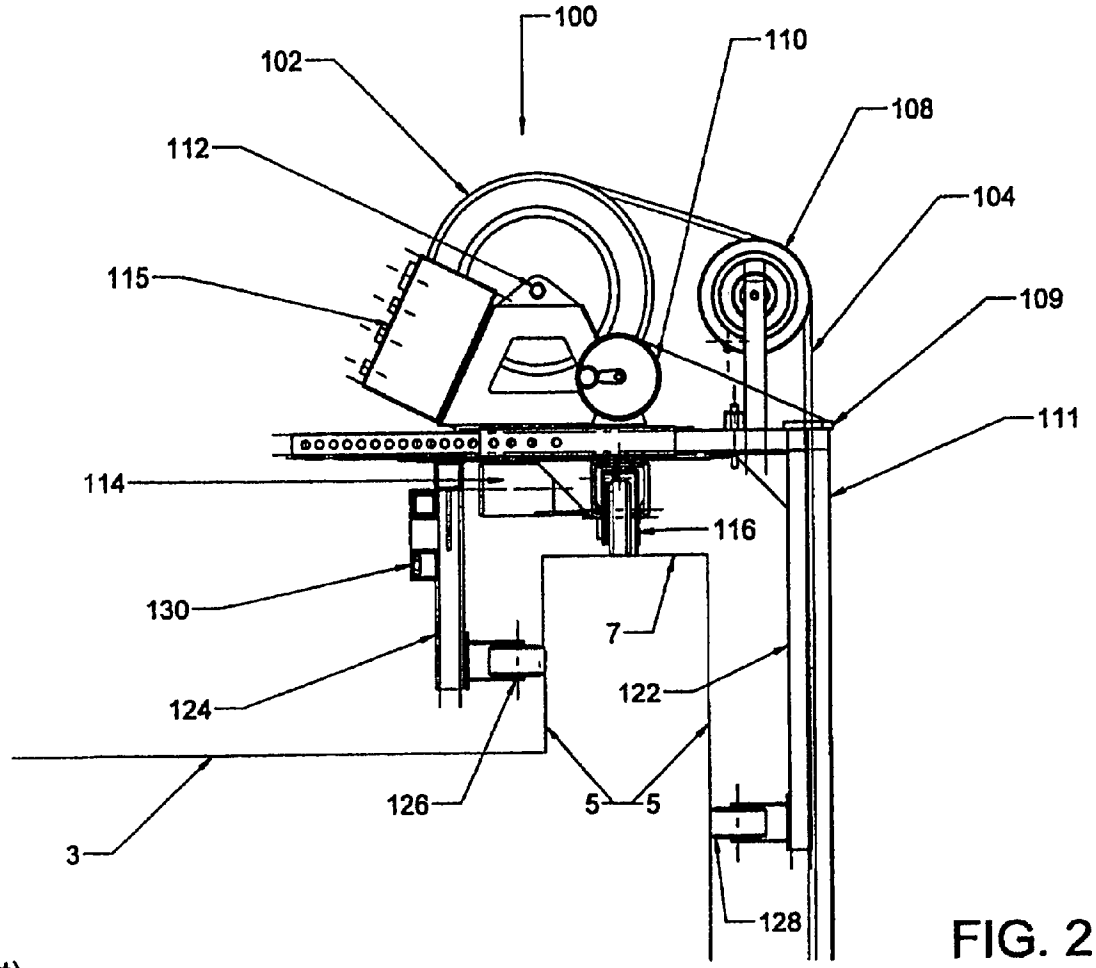
FIG. 2 (Prior Art)
FIG. 2 shows a side view of a carriage support and traveling mechanism used on a parapet wall to carry a cleaning system that is part of the PRIOR ART and may be used in conjunction with the novel technology described herein.

FIG. 2 shows a more limited side view of sections of the first component 100 positioned on the top lip 7 of parapet wall 5 adjoining the building roof 3. A motorized hose reel 102 (which may also perform with strong hose 104 construction as part of the second component [not shown] support system and counterbalancing system) provides the hose 104 and pulley 108 to direct the hose 104 towards the second component (not shown). A guide line storage winch 110 directs a support cable 111 through cable guide 109 towards the second component (not shown). There is a water supply input 112 into the hose reel 102, a motor such as a servo motor 114 for indexing or moving the first component 100 (and therefore also the second component) relatively horizontally with respect to the interior and exterior surfaces 5 of the top lip 7. Movement of the first component 100 is facilitated by wheels 116, 126 and 128 which contact various areas of the parapet wall 5. The first component is restrained and secured against unwanted movement away from the wall by a support system including interior wall support 124 (with wheel 126), exterior wall support 122 (with wheel 128) and the support provided by servo wheel 116. The servo motor 114 powers the carriage (relatively horizontal with respect to the surface to be cleaned) movement of the first component and the second component during use. That servo motor 114 may be directed by a processor, housed in control box 115, having a program therein that assists in the proper movement of the first component.

There may be sensors (e.g., 130) on the first component that detect the end of the building that provide a signal to the processor in control box 115, that the end of the building has been reached, so that the direction of the servo motor operation will timely reverse and move the first component (and the second component) in an alternate direction from previous travel to traverse the relatively vertical face of the wall or structure being cleaned). The processor may also be preprogrammed by an operator according to specific dimensions measured by the operator and/or the first component (by moving it an entire length of an edge and recording that dimension), and that dimension used to determine a reverse point in the operation of the cleaning system. The processor may also be programmed to control the motor that provides the vertical movement of the second component for the height of the building or the height of the surfaces to be washed (accounting for an entrance way height that is not to be cleaned). The processor may also direct control of the thruster(s) (23*a* and 23*b* of FIG. 1) and others. Sensed changes in wind conditions, rotational movement of the carriage, changes in forces at extreme ends of contact (or different brushes) on the carriage can be identified by the processor as cause to adjust the force of one or more thrusters and also to adjust (if available) the angle of thrust. Thrusters are known in the art in which the flanges or funnels at the exit port for emitted fluid streams can be adjusted by computer or manual control. This is another option within the practice of the present technology.

Figure 3:
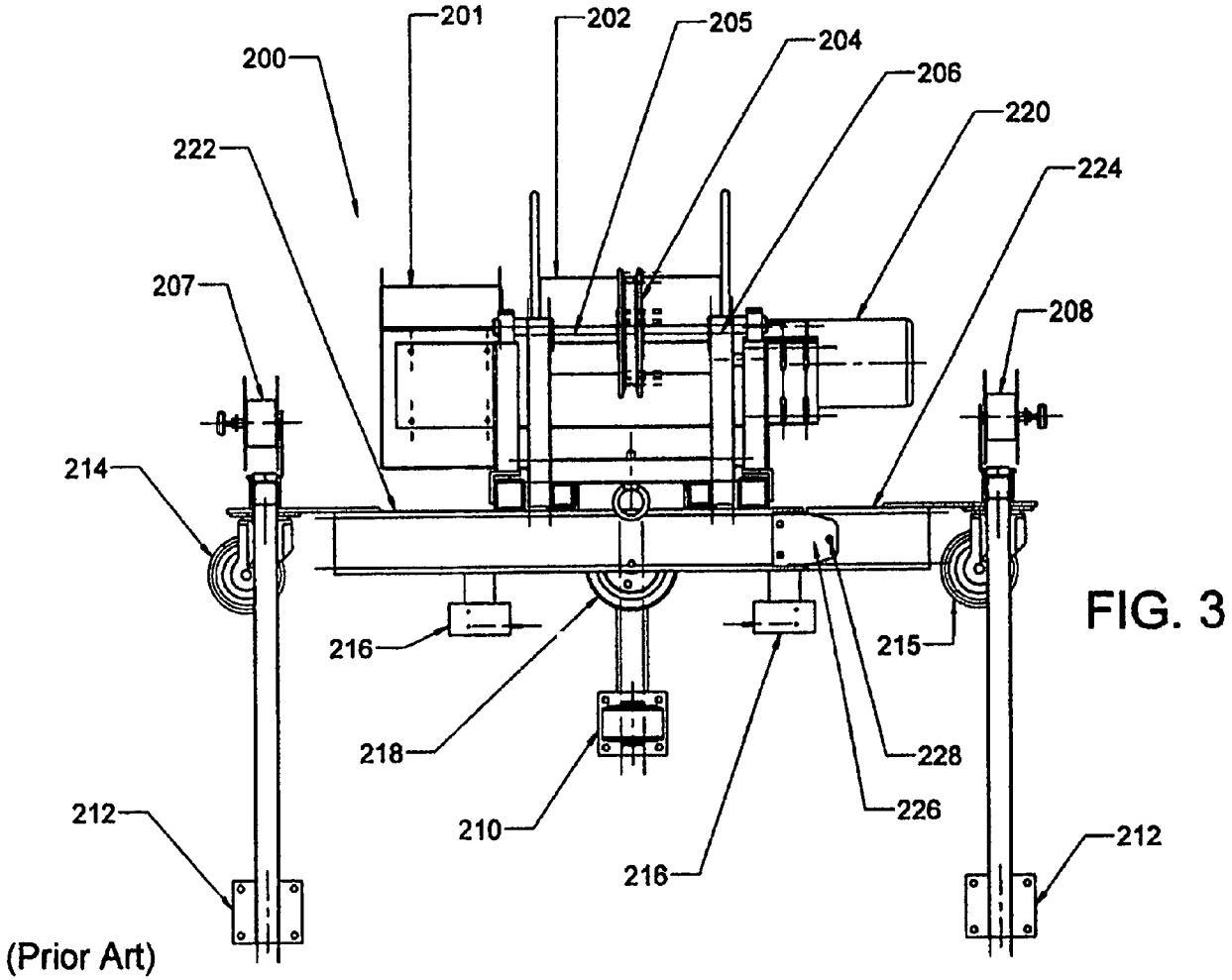
FIG. 3 (Prior Art)
FIG. 3 shows a back view of a carriage support and traveling mechanism used on a parapet wall to carry a cleaning system in the PRIOR ART, which can be modified to include thrusters according to the present technology.

FIG. 3 shows a front view of an embodiment of a first component 200 construction having a liquid supply hose dispenser 202 with a pulley 204 for guiding the supply hose (not shown) over the side of the building. Pulley 204 floats freely on shaft 205 and is constrained and supported by frame 206. This allows the hose to wind and unwind in layers on hose dispenser 202 for efficient operation and maximum storage capacity. There are two other dispensers/pulleys 207 and 208 that may provide feed of cable and lines to the second component (not shown). Interior wall braces 210 and exterior wall braces 212 are shown, along with transport wheels 214, 215 and 218 that support the first component 200 and rotate along a top flat area of the parapet wall (not shown). A motor 220 is shown that may drive the hose dispenser 202 and/or move wheels (such as 218) for their apparent functions. A system is provided to maintain sufficient force to allow traction for drive wheel 218, while compensating for varying elevations of the top of the parapet wall surfaces. The drive wheel 218 and support wheel 214 are rigidly mounted to the main support frame 222. Attached to swing arm frame 224 is support wheel 215. Swing arm 224 is connected to the main support frame 222 by pivot bolt 228 through brackets 226, which are rigidly mounted to main support frame 222. There is a control box 201 into which programming or operator input may be provided to control automatic movements and analysis of sensing by the system. The main structural support is shown as a main frame 222 and a swing arm frame 224, connected to the main frame 222 through a pivot bolt 228. There may be two opposed (each facing outwardly) photoswitch housings 216 that sense an approach to an edge or wall, sending a signal (by wire or wireless) to the control box 201, causing the movement of the first component 200 to stop or to stop and reverse.

An alternative traction and support system for components 200 may be comprised of a support wheel on one end of the main frame and a traction wheel at the other end.

Figure 4A:
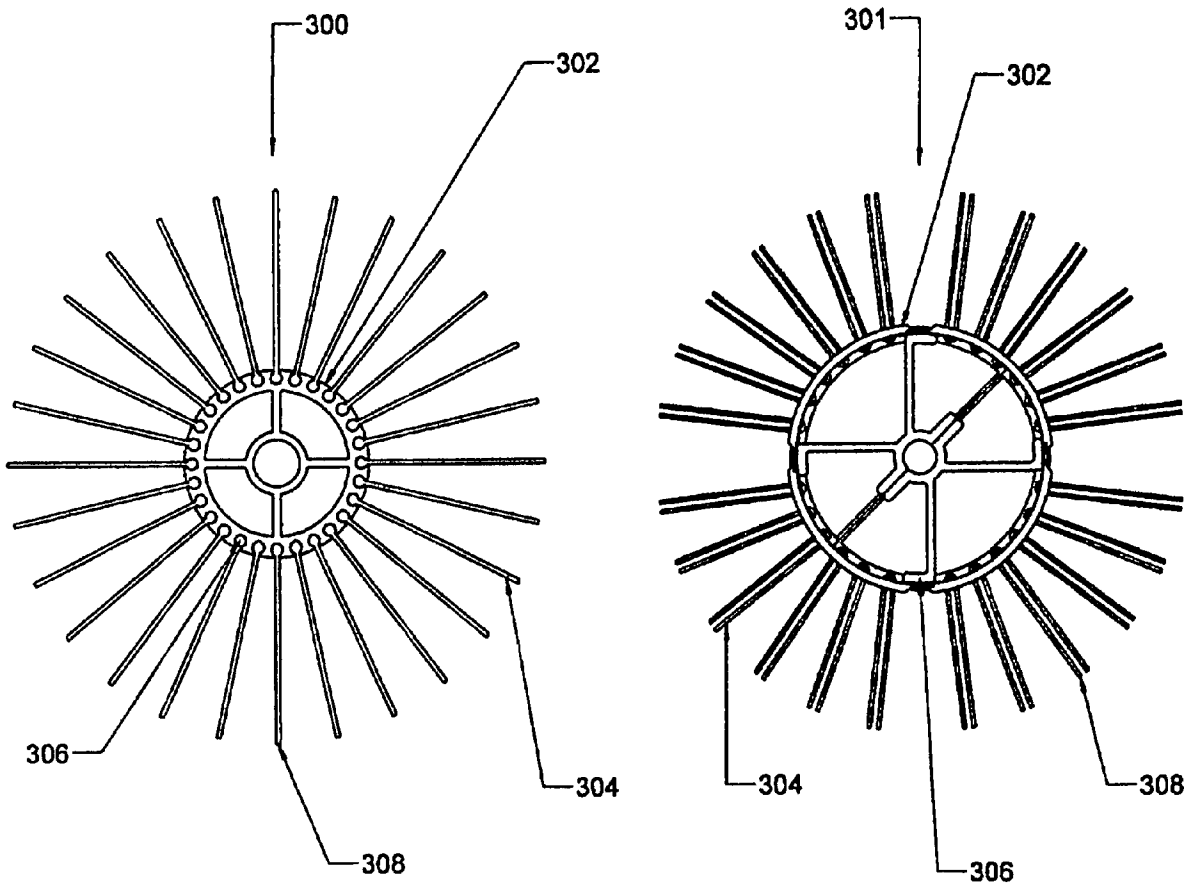
FIG.4a (Prior Art)
FIG. 4*a* shows two different side views of different possible force providing assemblies for the second component comprising a support body having multiple vanes of flexible force applying material in the PRIOR ART, which can be modified to include thrusters according to the present technology.

FIG. 4*a* shows an optional force providing assembly 300 for use as one embodiment of the second component comprising a support body 302 having multiple vanes 304 of flexible force applying material. One method of effecting a locking element 306 is shown that secures the vanes into the support body 302. An optional non-abrasive weighted tip 308 is also shown on a vane 304 to reduce wear of the vanes 304. FIG. 4*b* shows a perspective image of the assembly 300 with a single groove 310 shown in the support body 302, the single groove and a single shadow image of a single vane 312 shown for simplicity. When the vane 312 becomes worn over time, the vane 312 may be slid along direction D (in FIG. 4*b*) out of the groove 310 for easy replacement, the ball locking mechanism 306 retaining the vane 312 within the groove during rotation of the support body 302 in the second component (not shown).

The optional format of assemblies 300 may vary in size and have diameters between about 20 and 90 centimeters, with the vanes being about 8 to 40 centimeters in length. The composition of the vanes is not critical, but some materials are more desirable than others. For example, vanes of polymeric filament or brushes provide good material removal, but can be too abrasive on glass surfaces. Cloth or fabric materials are less abrasive, but tend to be too expensive and can wear out quickly. Porous or closed cell foam strips (as are used in some car washing systems) have been found to be a good balance, with relatively low cost and low abrasion resistance, yet a reasonable wear life.

FIG. 4*a* shows two alternative different types of a force providing embodiment of a typical assembly 300 for the second component comprising a support body 302 having multiple vanes of flexible force applying material 304. Section A in FIG. 4*b* is used for the detail section showing an individual vane 312 engaged within a groove 310 of the support body 302 and to provide additional force created by the centrifugal force from the rotating action of support body 302.

FIG. 4*b* shows a perspective image of the assembly 300 with a typical groove 310 shown in the support body 302. When the vane 312 becomes worn over time, the vane 312 may be slid along direction D out of the groove 310 for easy replacement. Vanes 312 are retained in grooves 310 by an interference between the two diameters.

Figure 4C:
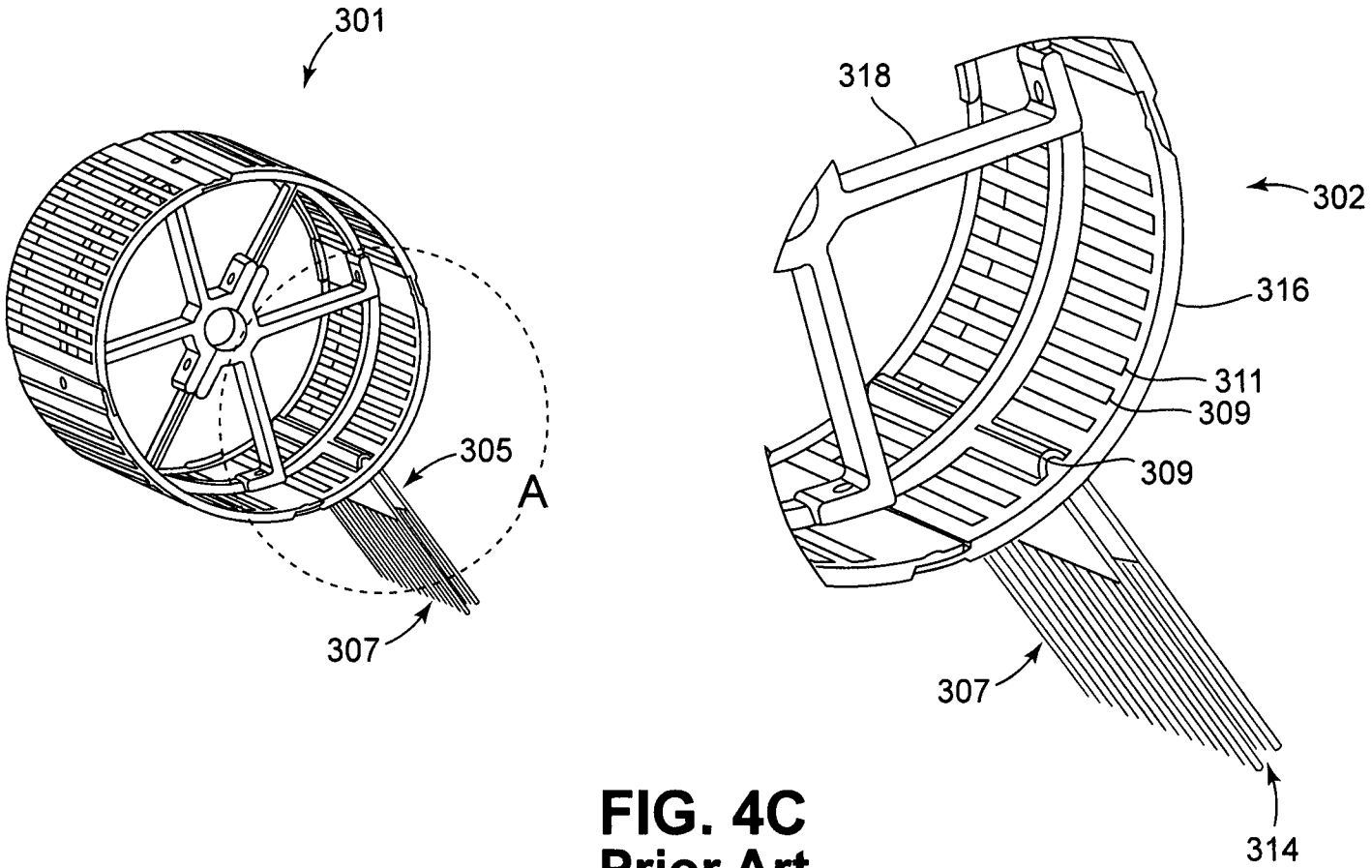
FIG. 4C Prior Art
FIG. 4*c* shows a perspective view and a cutaway view of a locking/engaging system for the support body and washing vanes in the PRIOR ART, which can be modified to include thrusters according to the present technology.

FIG. 4*c* shows a cutaway perspective and section of an assembly or end 301 for the support body 302. A single strip of vane material 305 forms two vanes 307 by looping through adjacent openings (e.g., similar to 309 and 311). This facilitates removal and replacement of vanes, as compared to the locking mechanism of FIG. 4*b*. In the section A, structural supports 318 stabilize the edge 316 of the support member 302. The ends 314 of the vanes tend to be separated by the spacing between the openings 309 and 311 in the support body 302. Vanes 312 are retained in grooves 310 by the looping of a vane strip between the grooves 309 and 311. In FIG. 4*c*, there are four plastic slotted vane holders 316 with folded in half vane 314 inserted from the inside of the support body 302. Four of these assemblies, e.g., 316 with 314, are bolted together to form a complete cylinder. Retainer 318 is fastened in the middle of the cylinder assembly and retains the vanes 314 into slotted vane holder 316 as well as providing a bore used to attach completed assembly to a shaft.

Figure 5A:
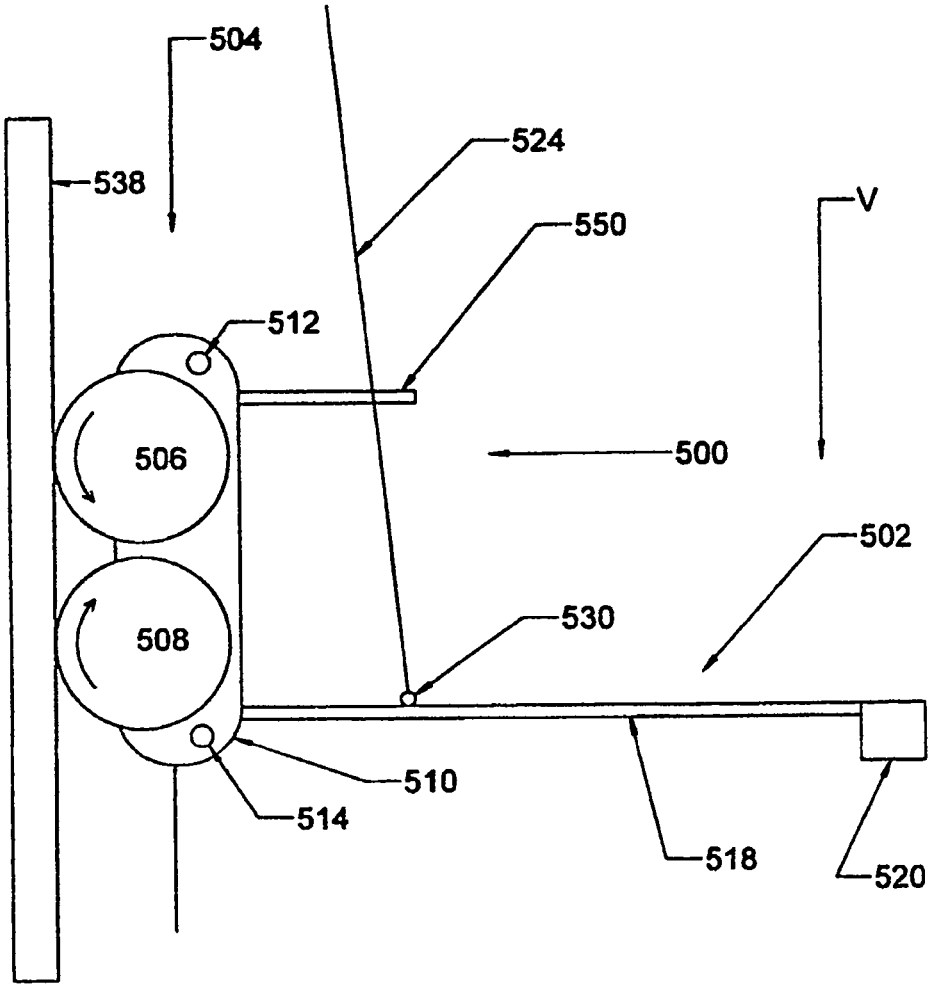
Fig. 5a (Prior Art)
FIG. 5*a* shows a schematic figure of a counterbalancing system employed in a vertical surface cleaning system in the PRIOR ART, which can be modified to include thrusters according to the present technology.
Figure 9:
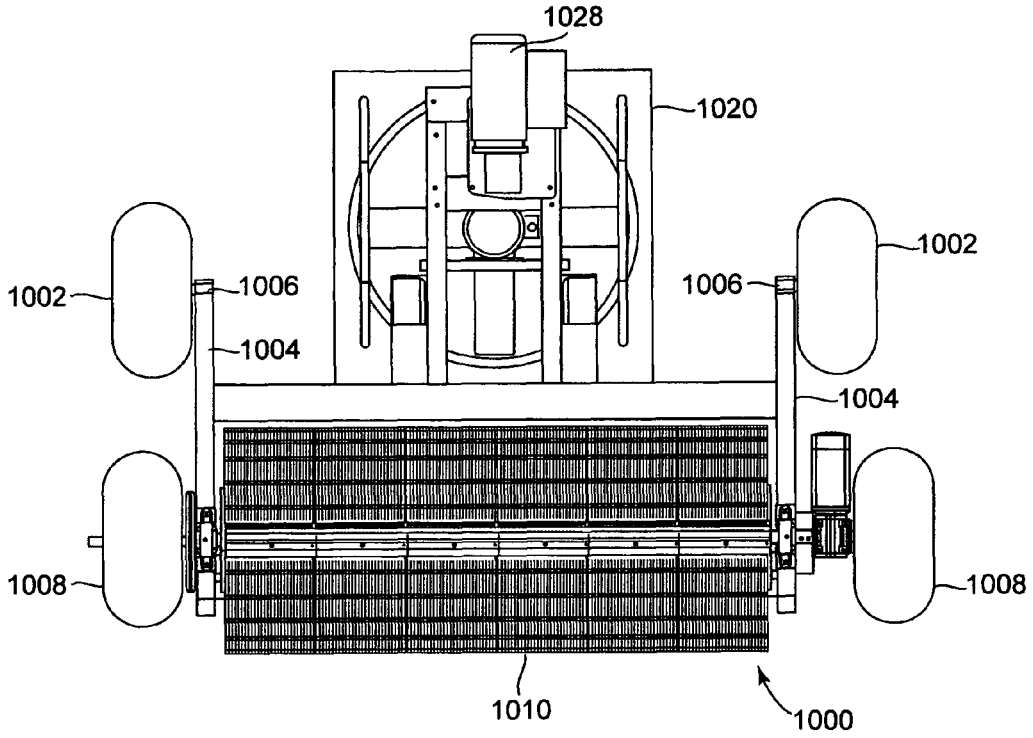
FIG. 9 shows a view of a cleaning device in an embodiment of the present technology as it would be viewed from a surface being cleaned.
Figure 10:
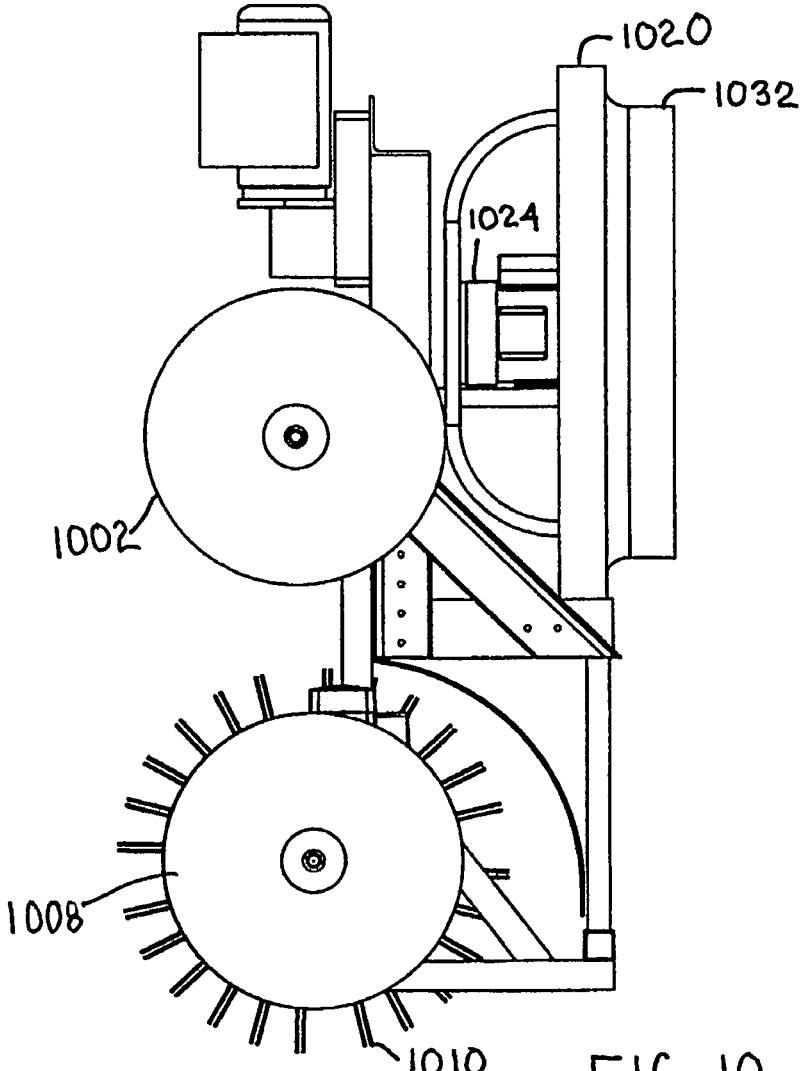
FIG. 10 shows a side view of the cleaning device of FIG. 9.

FIG. 5*a* shows a schematic figure of a counterbalancing system 502 employed in a vertical surface cleaning system 500 according to the PRIOR ART, to which the novel technology described herein (e.g., thrusters) may be added, as done in FIG. 1, FIG. 9 and FIG. 10. The vertical surface cleaning system 502 is shown in one embodiment as follows. The cleaning unit 504 itself comprises the housing 510, two opposed rotation brushes 506, 508 and a motor 512, 514 for each of the brushes 506, 508. Attached to the housing 510 or internal frame is a pole or other rigid or semi-rigid extending member 518, weight 520, cable connector 530 attached to cable 524 which is connected to a winch (not shown) or secured point on the roof (not shown). Cable guide 550 incorporated a slot that allows cable 524 to move inward towards building surface 538 as cleaning unit 504 moves up and the angle of cable 524 increases. Cable guide 550 has a back stop to prevent the cleaning unit 504 from tipping forward. Cable guide 550 provides rotational stability to cleaning unit 504 in respect to the axis at counter balance rod 518. The cleaning system 500 is shown relative to the vertical direction V and descriptions will be made with respect to that vertical direction as a 0° angle. Although the concept of counterbalancing and the mathematics relating to fulcrums, levers and forces in rotating bodies are well understood and easily applied to structural situations, the subtleties of the systems can be quite complex. The following discussion will discuss the issues in the counterbalancing of the forces in the cleaning system 500 in simple terms, correctly assuming that extreme mathematical subtleties of the system (such as the partial or complete transfer of points of rotation or pseudo-fulcrums) are not needed for practice of the described technology, and that routine experimentation and optimization by one ordinarily skilled in the art will address those issues. The term "vertical surface" does not require that the surface be precisely vertical, but that it has a sufficient vertical component that the cleaning system can rest against the surface during cleaning. An example of a "vertical surface" that is not completely vertical would be the windowed pyramid structure of the Luxor Hotel in Las Vegas, Nev.

It would be an ideal situation where opposed forces around all fulcrums, pseudo-fulcrums and points of rotation were exactly balanced to that under Newton's Second Law of Motion, there would be no rotation of the cleaning system. As the forces from the thrusters tend to be significant forces, their positioning, as explained before, is important. With an active system that is moving, being moved, having liquids carried and projected, and with motors and rotating brushes, a continuous perfect balancing of the system is not feasible. Additionally, rotation of a body can sometimes be a natural attempt of the body to stabilize itself, rotating mass to distribute forces into an orientation of elements where the forces are balanced. Hence, when a body supported by a cable is intentionally shifted out of balance, the resulting motion and forces are an attempt to return or move the body into a balanced position.

Figure 5B:
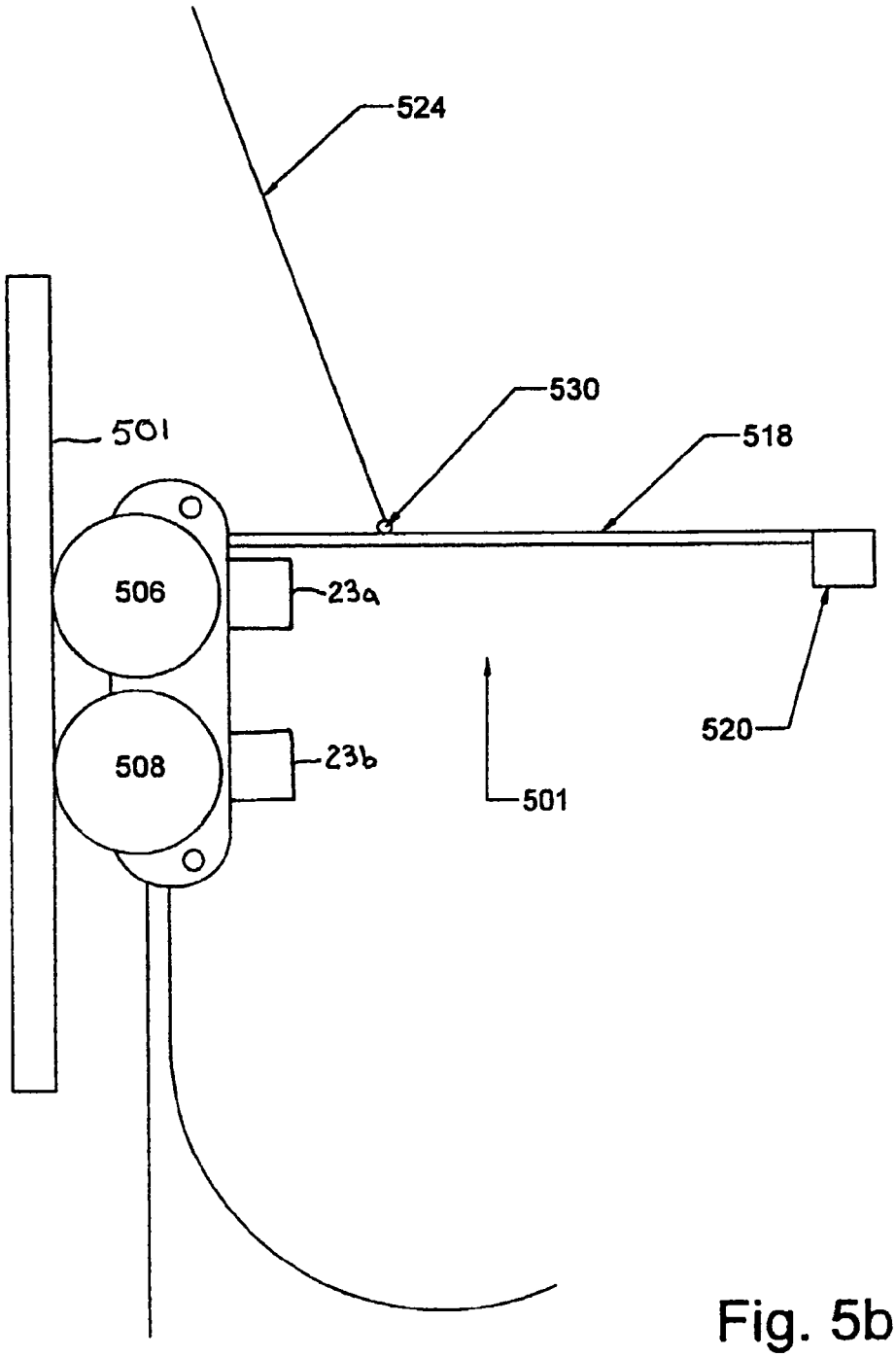
FIG. 5*b* shows a schematic figure of an alternative counterbalancing system employed in a vertical surface cleaning system which has thrusters according to the present technology.
Figure 5C:
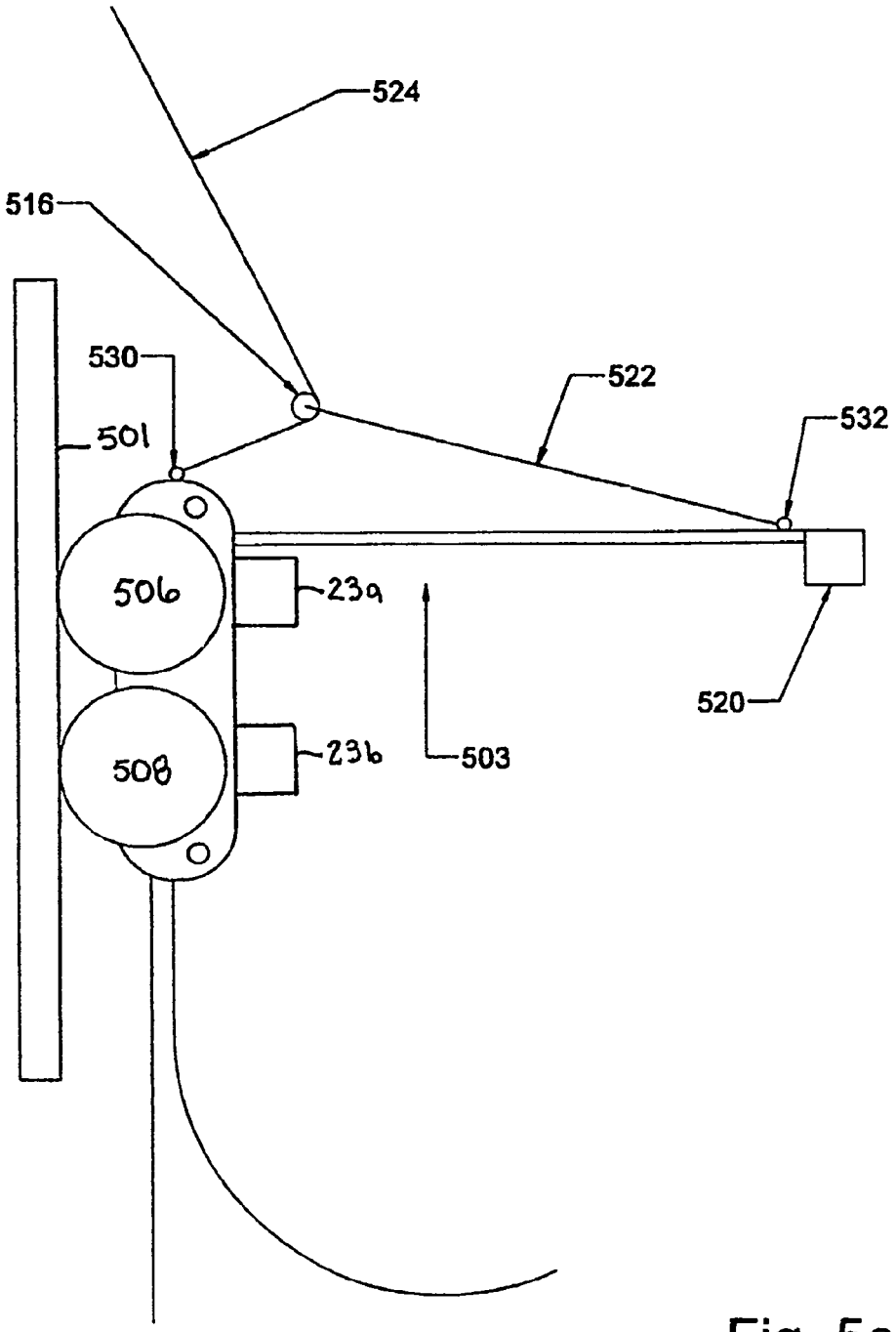
FIG. 5*c* shows a schematic figure of an alternative counterbalancing system employed in a vertical surface cleaning system which has thrusters according to the present technology.
Figure 5D:
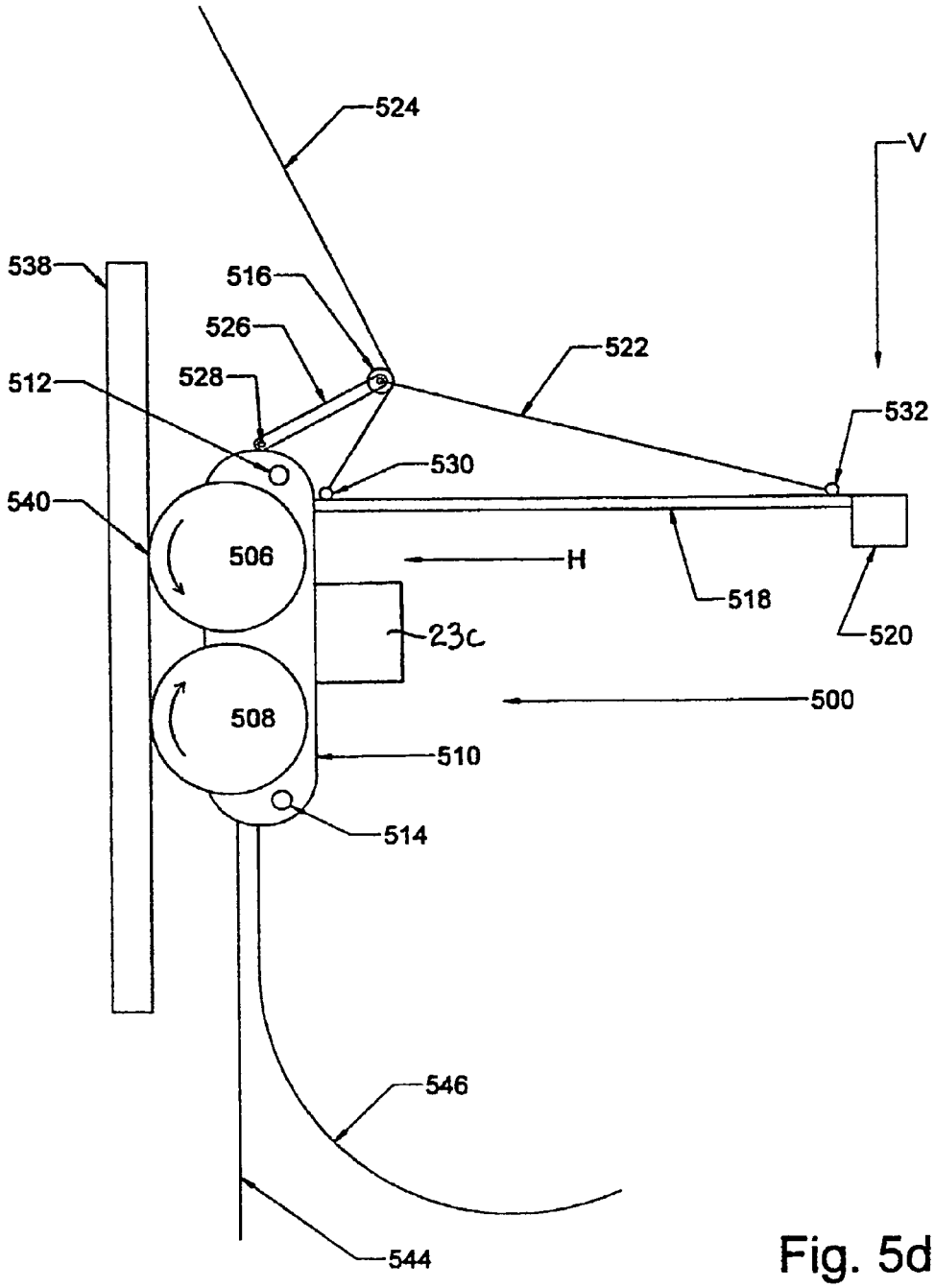
FIG. 5*d* shows a schematic figure of an alternative counterbalancing system employed in a vertical surface cleaning system which has thrusters according to the present technology.

FIGS. 5*b* and 5*c* show alternative cleaning structures with thrusters 23*a* and 23*b* positioned directly opposite rollers 506 and 508 although the thrusters 23*a* and 23*b* may be positioned so that their thrust, when directed perpendicularly against the wall 501 will have a total vector that is directed between the point of contact of the thrusters 23*a* and 23*b* and the wall 501. FIG. 5*d* shows a single thruster 23*c* positioned so that if the angle of thrust of the thruster 23*c* is not varied (e.g., by rotation or angling of the thruster 23*c* or adding deflectors), the full vector of the thrust will be between rollers 506 and 508.

It is also possible to have a sturdy hose (providing the liquid) operate as the support cable on which a winch operates to raise and lower the cleaning system. An electrical line providing current to the motor(s) in the cleaning system on the carriage can be attached to the hose and run parallel to the hose. Additional support cables for the entire system would again not be necessary, but could be optional.

In the system, by way of a non-limiting example it can be seen that there are two motors provided for the brushes 16 and 18, respectively. These motors drive the brushes in a counter-rotational direction (e.g., 16 counterclockwise and 18 clockwise, or vice versa).

Figure 6:
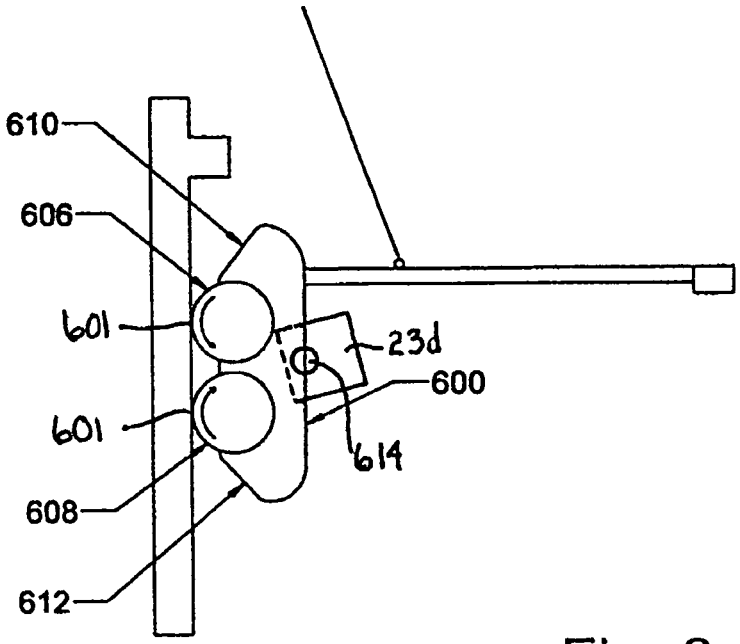
FIG. 6 shows a side view of a carriage support and traveling mechanism for use on a rooftop to carry a cleaning system with a single thruster according to the present technology.

FIG. 6 shows a schematic of other aspects of a cleaning system within the generic scope of the present disclosure. The counter-rotating brushes or cleaning elements 606 and 608 are shown. Counter rotation of the brushes 606 and 608 allows for single pass cleaning as this action gets to the top and bottom of the frames regardless of the direction of travel of the cleaning unit. A single rotatable, adjustable thruster 23*d* is shown with a rotation bearing 614. The thruster 23*d* may be rotated and shifted along at least two axes to direct thrust in response to commands by a processor or manual controls (not shown). The thruster will generally have a center of thrust force from the thruster 23*d* located within an area or line projected from points of contact 601 of the brushes 606 608 and the surface 4 to be cleaned. Of particular note in this figure is the shape of the edges 610 and 612 that would be adjacent the wall (not shown) and might impact any raised edges or frames on the wall. By having the edges form an acute angle with the wall, the edges 612 and 610, depending upon the direction of travel, would impact any raised elements and assist in the cleaning system 600 being able to climb over the raised element. At least one brush or cleaning element 606 and 608 would tend to remain in contact with the surface to be cleaned.

Figure 7:
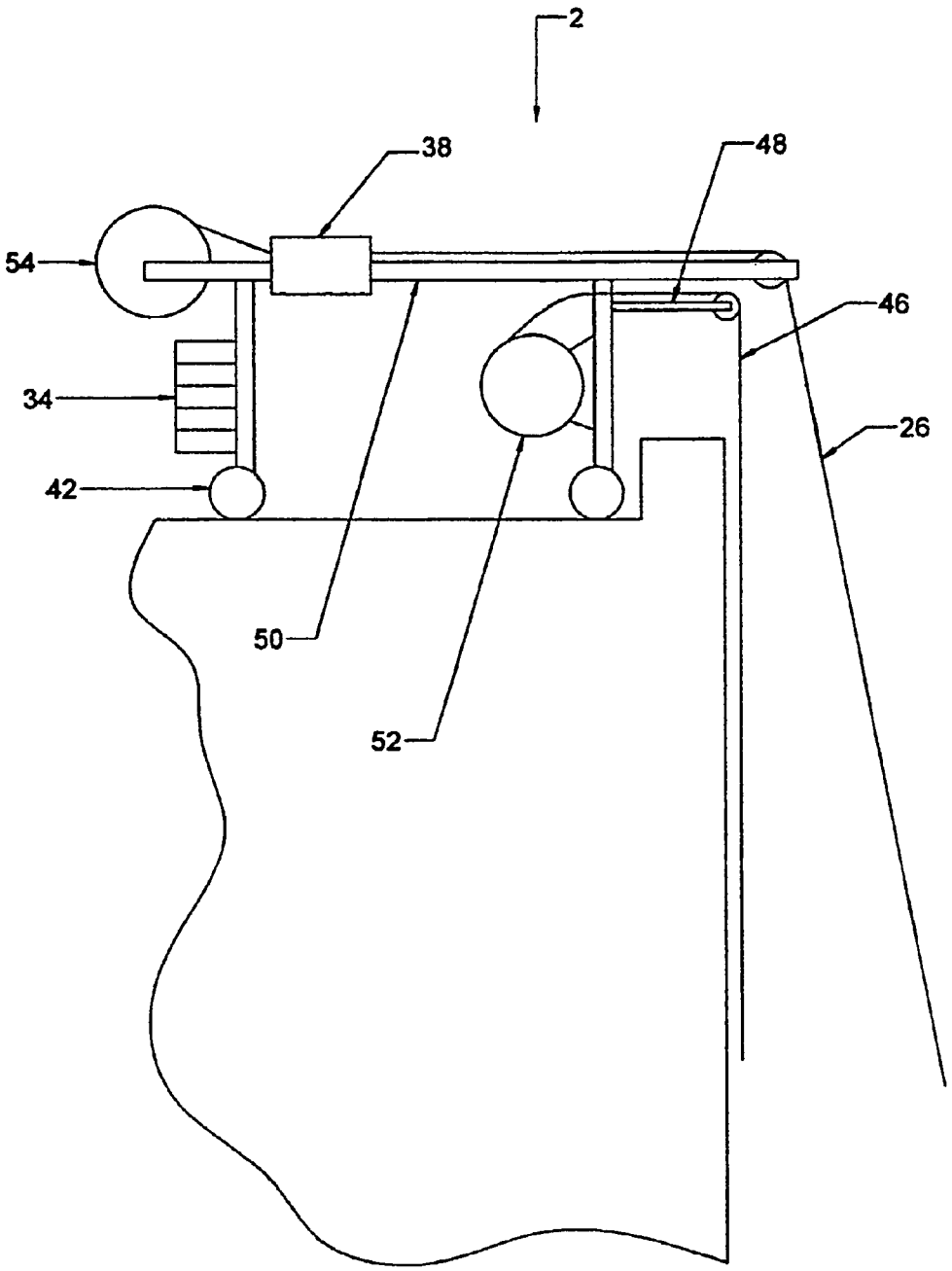
(Prior Art) Fig. 7
FIG. 7 shows a traveling cable and hose roof top system in the PRIOR ART, which can be modified to include thrusters according to the present technology.

FIG. 7 shows an alternative design for a roof carriage system for use with the window cleaners with thrusters of the present invention. The same numbers used in FIG. 2 describe like elements here. In addition, a second reel 52 for a second stabilizing or lift cable 46 is shown.

Figure 8:
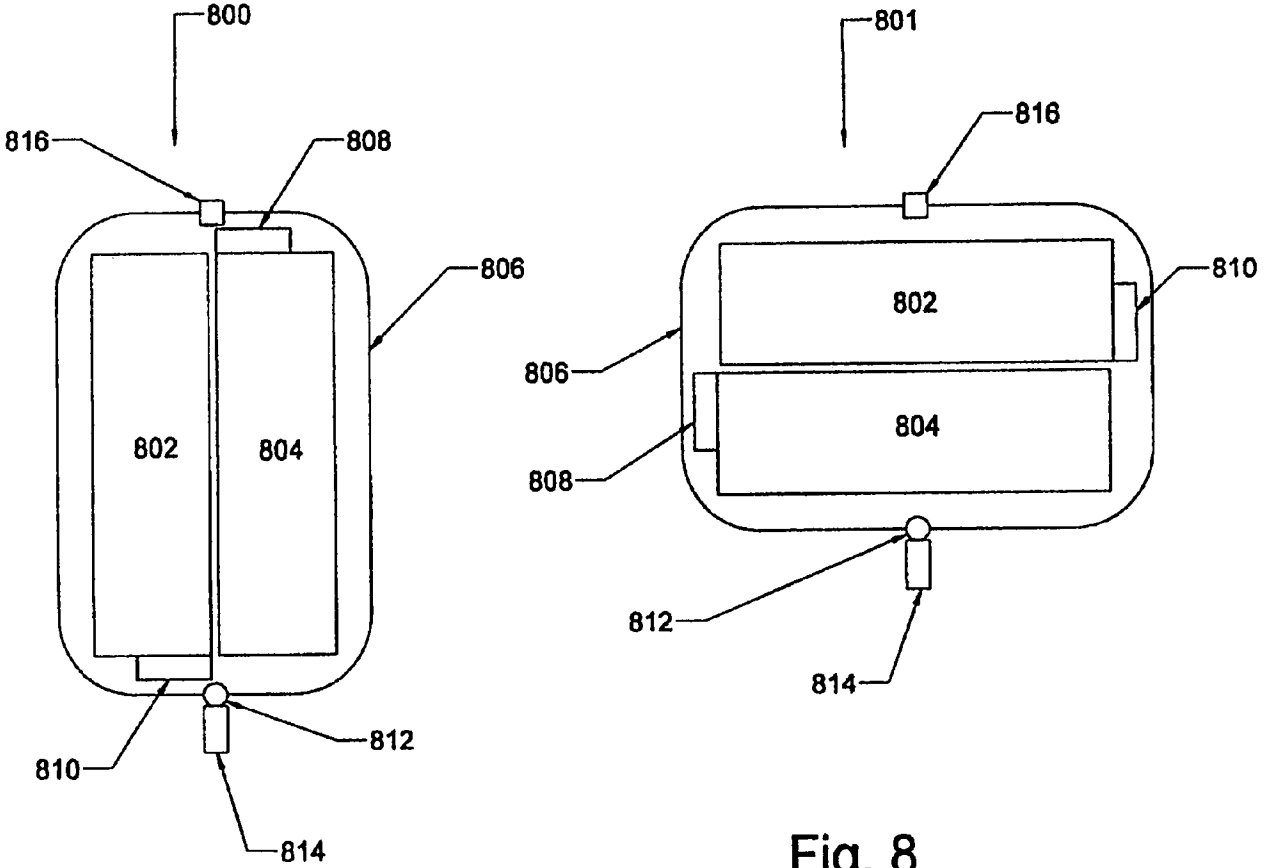
Fig. 8 (Prior Art)
FIG. 8 shows a back view or alternative water application and brush contact systems for use with herein described technology in the PRIOR ART, which can be modified to include thrusters according to the present technology.

FIG. 8 shows back views of alternative horizontal modes for cleaning units 800, and vertical mode cleaning units 801 and their water application and brush contact systems that are known in the PRIOR ART, but which may be used with herein described technology. Horizontal mode cleaning unit 800 shows one optional configuration for a unit for use when cleaning in a horizontal mode. The unit starts at the top and moves across the entire wall, then drops down 1 length of the brushes and travels back, and then repeats the sequence. Cleaning unit 801 shows an optional configuration for the unit for particular use in a vertical cleaning mode. Within FIGS. 8, 802 and 804 show the brushes, 806 is the housing, 808 is the drive motor for brush 804, 810 the drive motor for brush 802, 812 a counter balance weight support tube, 814 a counter balance weight, and 816 an upper cable guide.

FIG. 9 shows a view of an embodiment of the present technology as it would be viewed from a surface being cleaned. The cleaning device 1000 is shown with two upper rollers 1002 having a rotation axis 1006 supported on rigid or pivoting arms 1004. Tow lower rollers 1008 are shown on a common axis (not critical, but preferred) with the washing blades or fringes 1010. A smaller washing unit 1000 is exemplified here, such as one having less than a 3 meter long washing fringes 1010 so that a single thruster 1020 may be used to provide stabilizing forces. As the length of the blades increases, more thrusters would be (symmetrically) spaced along the length of the blades 1026 to stabilize the length of the washing blades. Fan blades 1026 and a motor 1028 to drive the blades are shown.

FIG. 10 shows a side view of the cleaning device of FIG. 9, with like numbers indicating like elements. Also shown is the thruster funnel 1032 for focusing the thrust gas (air) from the thruster. The funnel 1026 may itself be adjustable to direct thrusting gas, or the entire thruster 1020 may pivot and be moved to provide angular adjustments to the forces of the thruster 1000.

Figure 11:
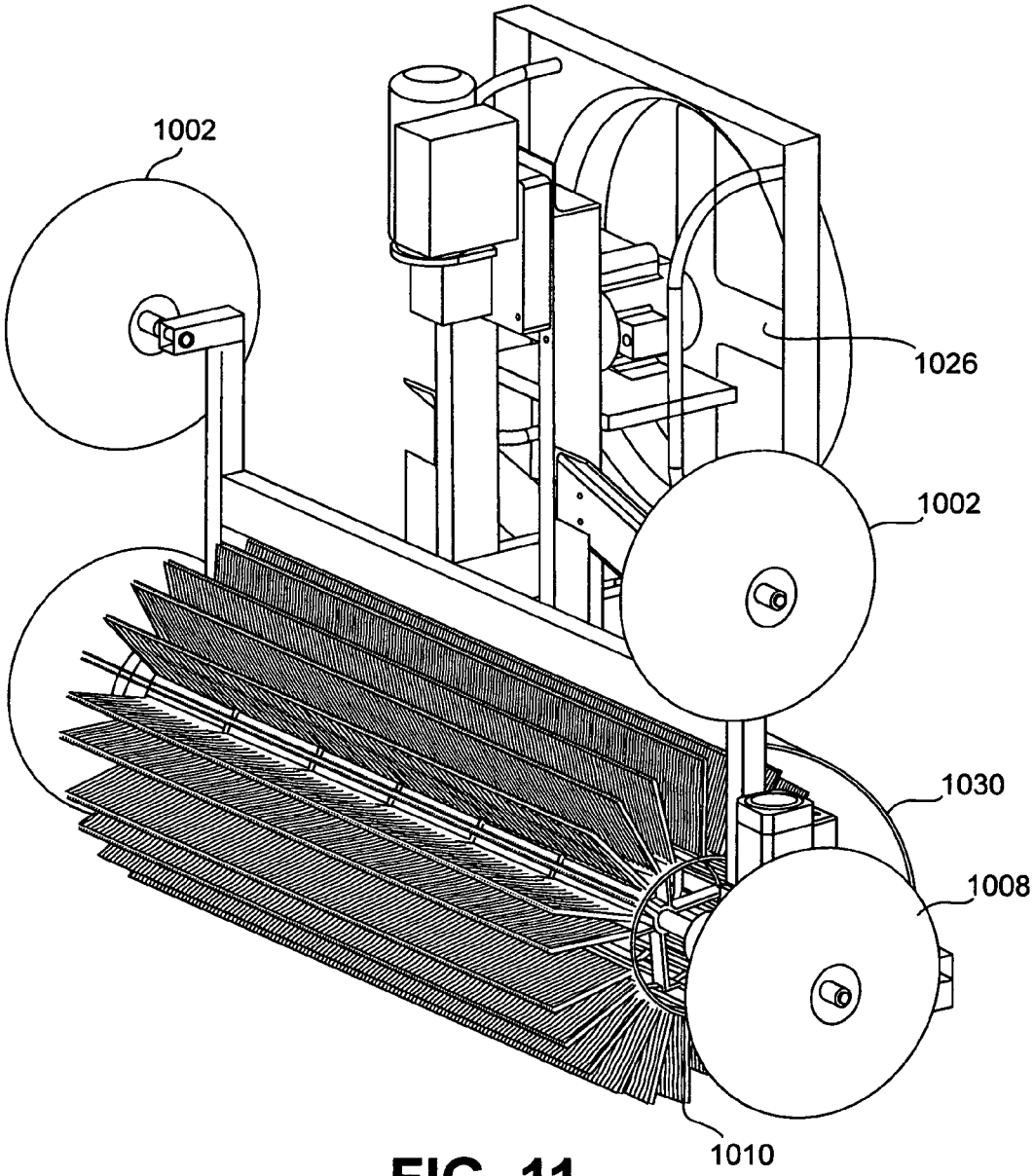
FIG. 11 shows a perspective view of the cleaning device of FIG. 9 and FIG. 10

FIG. 11 shows a perspective view of the cleaning device of FIG. 9 and FIG. 10, with like numbers indicating like elements. A spray deflection or entrapment panel 1030 is also shown. The washing panels 1010 may be brushes, flaps, fabric, polymer, natural fiber, sheets or the like.

The equipment moving system of the prior art included within some elements of FIGS. 1-8 may be used in combination with the novel thruster systems described herein, without having to use counterbalancing weights. The thruster system may be used with the carriages fixed to upper levels of buildings or merely temporarily positioned on the upper levels of buildings. The thruster(s) distribution will depend upon the size of the cleaning device and the stressful (wind) conditions to which it will be subject during use. As noted above, the smaller system used in less windy conditions may comprise a single thruster that is approximately horizontally symmetrically placed. A next larger size system, useful in windier environments might be 2-4 meters in brush length (width of the device) and have at least two (preferably horizontally and vertically symmetrically) disposed thrusters. Still larger versions (such as 3-5 meters in width) might have three thrusters. The use of three thrusters actually provides excellent stability as does three-point contact as a minimum stabilizing contact between surfaces. Although it is preferred that the three thrusters would be equilaterally placed with respect to each other, horizontal and vertical symmetry becomes less critical because of the equilateral distribution.

Power for the thrusters is preferably electrical, transmitted to an electrical motor by cable. Combustion engines may be used, with either a tank provided on the device or with a fuel line, but this would be less preferred. Battery operated electrical systems may be used, but preferably the battery would be a back-up system in case of power outages or disconnection of the cable. Combustion engines may be carried on the carriages to drive the thrusters, but this is less economical and would require regular refueling. Adding a fuel line from the roof to the combustion engine would create undesirable risks.

The thrusters may be fans, compressors, jets or any other format of delivering thrust gas power from a system. Even hoses from a compressor may be fed to a delivery thruster as opposed to a thruster where the compression forces on the gas emitted are created at the thruster itself. For example, high pressure gas may be provided from the roof (from tanks or a motor) and fed to controlled outlets on the moveable carriages described herein.

The angle of control of the emitted thruster gas can be controlled in a number of ways. The thrusters may be fixed, and panels (similar to ailerons) may deflect the gas stream to adjust the force and stabilizing control provided by the thruster. The emitted gas may exit through a funnel or tube that can swivel or pivot to adjust the angle of exit of the gas stream from the thruster, with the pivot or angular adjustment point being within a housing for the thruster, at a surface of the thruster, or exterior to the surface of the thruster. These ailerons or angular variation delivery ports may be computer controlled, as are angular adjustment ports on high performance jet engines.

Another simple control of thrust forces can be provided by the use of vanes on the rear (away from the building) side of the cleaning device that are placed in a vented gas or thrust stream. By altering the angle of the vanes on the back of the device, the direction of forces transmitted through the structure of the device can also be controlled.

It is also within the scope of the invention to have brushes that incidentally contact the surface to be cleaned or are directed angularly outward (even parallel to the surface to be cleaned or obtuse to that surface) which can clean side walls, ledges, frames and other elements adjacent the surface to be cleaned, especially when they are windows. Additionally, with the thrusters of the present technology, the cleaning elements may be rotary brushes that spin in a plane parallel to the window surface or nearly parallel to the window surface, with multiple brushes either spaced part, contacting each other at the extremities, or overlapping each other at the extremities. With the brushes contacting each other while rotating clockwise and counterclockwise, their contact points will push each other along, and not drag on each other. The brushes may be inline, or staggered slightly off line (e.g., a zig-zag line would be needed to connect centers of rotation). These brushes would be made of conventional materials in order to wash windows.

These examples and figures are intended to be non-limiting examples of the practice of the present technology and optional and alternative constructions using the thruster principles of the present technology may be used.

What is claimed:

1. An apparatus for cleaning an upright surface of a structure comprising:

a carriage adapted to be moved in upward and downward directions relative to an upright surface of a structure, a cleaning element rotatably mounted on the carriage for rotation about a generally horizontal axis, said cleaning element having members with outer end portions that contact a surface area of the upright surface horizontally aligned with the axis of rotation of the cleaning element for cleaning said surface area of the upright surface, a thruster mounted on the carriage operable to produce a thrust force that is perpendicular to the surface area being cleaned and horizontally aligned with said surface area and to maintain the outer end portions of the cleaning element in contact with the surface area of the upright surface of the structure during cleaning thereof, said thruster is a fan having a horizontal axis of rotation horizontally aligned with the horizontal axis of rotation of the cleaning element, and a motor operable to rotate the fan to produce the thrust force that is perpendicular to the surface area being cleaned.

2. The apparatus of claim 1 including:

a processor programmed to adjust the operation of the motor to vary the force produced by the fan to maintain the outer end portions of the cleaning element in contact with the surface area of the upright structure being cleaned.

3. The apparatus of claim 1 including:

a rigid member connected to the carriage and extended away from the upright surface, and a weight mounted on the rigid member to provide a force for stabilizing the carriage and cleaning element.

4. The apparatus of claim 1 including:

a support adapted to be mounted on the structure above the upright surface, a winch mounted on the support, a cable connecting the winch to the carriage, and a power unit connected to the winch for operating the winch to move the cable whereby the carriage is moved in upward and downward directions relative to the upright surface of the structure.

5. The apparatus of claim 4 including:

a processor programmed to control the power unit to adjust the upward and downward movement of the carriage and cleaning element.

6. The apparatus of claim 1 including:

at least one gyroscope mounted on the carriage for stabilizing the carriage and cleaning element whereby the outer end portions of the cleaning element are maintained in contact with the surface area of the upright surface of the structure during cleaning thereof.

7. The apparatus of claim 1 including:

at least one applicator mounted on the carriage operable to dispense deionized water on the upright surface of the structure adjacent the cleaning element.

8. An apparatus for cleaning an upright surface of a structure comprising:

a carriage adapted to be moved in upward and downward directions relative to an upright surface of a structure, a first cleaning element rotatably mounted on the carriage for rotation about a generally horizontal first axis of rotation, said first cleaning element having members with outer end portions that contact a first surface area of the upright surface horizontally aligned with the first axis of rotation of the first cleaning element, a second cleaning element rotatably mounted on the carriage for rotation about a generally horizontal second axis of rotation, said second cleaning element having members with outer end portions that contact a second surface area of the upright surface horizontally aligned with the second axis of rotation of the second cleaning element, a first thruster mounted on the carriage operable to produce a first thrust force that is perpendicular to the surface being cleaned and horizontally aligned with said first surface area and to maintain the outer end portions of the first cleaning element in contact with the first surface area of the upright surface of the structure, the first thruster is a first fan having a horizontal axis of rotation horizontally aligned with the horizontal axis of rotation of the first cleaning element, a first motor operable to rotate the first fan to produce a thrust force that is perpendicular to the first surface area being cleaned, a second thruster mounted on the carriage operable to produce a second thrust force that is perpendicular to the surface being cleaned and horizontally aligned with said second surface area and to maintain the outer end portions of the second cleaning element in contact with the second surface area of the upright surface of the structure, the second thruster being a second fan having a horizontal axis of rotation horizontally aligned with the horizontal axis of rotation of the second cleaning element, and a second motor operable to rotate the second fan to produce a thrust force that is perpendicular to the second surface area being cleaned.

9. The apparatus of claim 8 including:

a processor programmed to adjust the operations of the first and second motors to vary the forces produced by the first and second fans to maintain the outer end portions of the first and second cleaning elements in contact with the first and second surface areas of the upright structure being cleaned.

10. The apparatus of claim 8 including:

a rigid member connected to the carriage and extended away from the upright surface, and a weight mounted on the rigid member to provide a force for stabilizing the carriage and cleaning element.

11. The apparatus of claim 8 including:

a support adapted to be mounted on the structure above the upright surface, a winch mounted on the support, a cable connecting the winch to the carriage, and a power unit connected to the winch for operating the winch to move the cable whereby the carriage is moved in upward and downward directions relative to the upright surface of the structure.

12. The apparatus of claim 11 including:

a processor programmed to control the power unit to adjust the upward and downward movement of the carriage and cleaning element.

13. The apparatus of claim 8 including:

at least one gyroscope mounted on the carriage for stabilizing the carriage and first and second cleaning elements whereby the outer end portions of the first and second cleaning elements are maintained in contact with the first and second surface areas of the upright surface of the structure during cleaning thereof.

14. The apparatus of claim 8 including:

at least one applicator mounted on the carriage operable to dispense deionized water on the upright surface of the structure adjacent one of the first and second cleaning elements.

15. An apparatus for cleaning an upright surface of a structure comprising:

a carriage adapted to be moved in upward and downward directions relative to an upright surface of a structure, a cleaning element rotatably mounted on the carriage for rotation about a generally horizontal axis, said cleaning element having members with outer end portions that contact a surface area of the upright surface horizontally aligned with the axis of rotation of the cleaning element for cleaning said surface area of the upright surface, and a thruster mounted on the carriage operable to produce a thrust force that is horizontally aligned with the horizontal axis of rotation of the cleaning element, perpendicular to the surface area being cleaned and horizontally aligned with said surface area being cleaned and to maintain the outer end portions of the cleaning element in contact with the surface area being cleaned of the upright surface of the structure during cleaning thereof.

16. The apparatus of claim 15 including:

a support adapted to be mounted on the structure above the upright surface, a winch mounted on the support, a cable connecting the winch to the carriage, and a motor connected to the winch for operating the winch to move the cable whereby the carriage is moved in upward and downward directions relative to the upright surface of the structure.

17. The apparatus of claim 16 including:

a processor programmed to control the motor to adjust the upward and downward movement of the carriage and cleaning element.

18. The apparatus of claim 15 including:

a processor programmed to adjust the force produced by the thruster to maintain the outer end portions of the cleaning element in contact with the surface area of the upright structure being cleaned.

19. The apparatus of claim 15 including:

at least one gyroscope mounted on the carriage for stabilizing the carriage and cleaning element whereby the outer end portions of the cleaning element are maintained in contact with the surface area of the upright surface of the structure during cleaning thereof.

20. The apparatus of claim 15 including:

at least one applicator mounted on the carriage operable to dispense deionized water on the upright surface of the structure adjacent the cleaning element.

* * * * *